US009360195B2

(12) United States Patent
Goeckel et al.

(10) Patent No.: US 9,360,195 B2
(45) **Date of Patent: *Jun. 7, 2016**

(54) UTILITY ILLUMINATION DEVICE

(71) Applicants: Gregory William Goeckel, Ofallon, IL (US); David P. Bohman, Nashville, TN (US)

(72) Inventors: Gregory William Goeckel, Ofallon, IL (US); David P. Bohman, Nashville, TN (US)

( * ) Notice: Subject to any disclaimer, the term of this patent is extended or adjusted under 35 U.S.C. 154(b) by 77 days.

This patent is subject to a terminal disclaimer.

(21) Appl. No.: 14/494,062

(22) Filed: Sep. 23, 2014

(65) Prior Publication Data

US 2015/0009661 A1 Jan. 8, 2015

Related U.S. Application Data

(63) Continuation of application No. 13/627,844, filed on Sep. 26, 2012, now Pat. No. 8,870,414.

(60) Provisional application No. 61/539,140, filed on Sep. 26, 2011.

(51) Int. Cl.

| | |
|---|---|
| ***F21S 4/00*** | (2006.01) |
| ***F21V 21/00*** | (2006.01) |
| ***F21V 21/14*** | (2006.01) |
| ***F21V 7/00*** | (2006.01) |
| ***F21V 7/04*** | (2006.01) |
| ***F21K 99/00*** | (2016.01) |

(Continued)

(52) U.S. Cl.

CPC ..... *F21V 21/14* (2013.01); *F21K 9/175* (2013.01); *F21V 7/00* (2013.01); *F21V 7/04* (2013.01); *F21V 7/043* (2013.01); *F21V 14/02* (2013.01); *F21V 19/0075* (2013.01); *F21V 19/02* (2013.01); *F21V 21/096* (2013.01); *F21Y 2103/00* (2013.01); *F21Y 2103/003* (2013.01)

(58) Field of Classification Search

CPC ..... F21K 9/175; F21V 7/00; F21V 7/04; F21V 7/043; F21V 14/02; F21V 14/025; F21V 14/04; F21V 14/045; F21V 14/065; F21V 14/085; F21V 19/0075; F21V 19/008; F21V 19/02; F21V 21/096; F21V 21/0965; F21V 21/14; F21V 21/145

USPC ..... 362/35, 190–191, 249.02–249.03, 362/249.07, 249.1–249.11, 269, 285, 287, 362/311.02, 396, 418, 427–430, 800

See application file for complete search history.

(56) References Cited

U.S. PATENT DOCUMENTS

| | | | |
|---|---|---|---|
| 3,331,958 | A | 7/1967 | Adler |
| D244,876 | S | 6/1977 | Zelina |

(Continued)

OTHER PUBLICATIONS

AutoZone, Inc., Brochure displaying lighting devices, downloaded Jul. 19, 2011.

(Continued)

*Primary Examiner* — Jason Moon Han

(74) *Attorney, Agent, or Firm* — Thomas E. Lees, LLC

(57) ABSTRACT

A utility illumination device comprises a first end member, a second end member and a light tube coupled between the first end member and the second end member. The first end member has at least one faceted surface along an edge thereof. Analogously, the second end member has at least one faceted surface along an edge thereof. The illumination device further comprises an illumination assembly within the light tube that comprises a light source. The illumination device is manually adjustable to change the direction of light emitted from the illumination device.

20 Claims, 25 Drawing Sheets

(51) Int. Cl.

| | |
|---|---|
| ***F21V 14/02*** | (2006.01) |
| ***F21V 19/00*** | (2006.01) |
| ***F21V 19/02*** | (2006.01) |
| ***F21V 21/096*** | (2006.01) |
| *F21Y 103/00* | (2016.01) |

(56) References Cited

U.S. PATENT DOCUMENTS

| | | | |
|---|---|---|---|
| 4,054,791 | A | 10/1977 | Du Shane |
| D251,267 | S | 3/1979 | Zelina |
| 4,282,564 | A | 8/1981 | McJunkin, Jr. et al. |
| 4,389,699 | A | 6/1983 | Qualls |
| 4,672,515 | A | 6/1987 | Baker |
| 4,816,969 | A | 3/1989 | Miller |
| 5,243,505 | A | 9/1993 | Carr |
| D353,165 | S | 12/1994 | LeMarr et al. |
| D353,907 | S | 12/1994 | Doria |
| 5,436,815 | A | 7/1995 | Grooms et al. |
| D365,164 | S | 12/1995 | Yuen |
| 5,528,477 | A | 6/1996 | Carmo |
| 5,921,658 | A | 7/1999 | Kovacik et al. |
| 5,975,719 | A | 11/1999 | Reiff et al. |
| D421,142 | S | 2/2000 | Bayat |
| D428,174 | S | 7/2000 | Yuen |
| 6,386,736 | B1 | 5/2002 | Reiff et al. |
| 6,601,814 | B2 | 8/2003 | Kovacik et al. |
| D483,508 | S | 12/2003 | Galvez |
| D483,893 | S | 12/2003 | Galvez |
| 6,663,265 | B2 | 12/2003 | Kovacik et al. |
| 6,857,756 | B2 | 2/2005 | Reiff et al. |
| D505,217 | S | 5/2005 | Bayat et al. |
| 6,984,054 | B2 | 1/2006 | Lai |
| 7,150,540 | B2 | 12/2006 | Kovacik et al. |
| 7,175,303 | B2 | 2/2007 | Kovacik et al. |
| D540,484 | S | 4/2007 | Bayat et al. |
| D541,962 | S | 5/2007 | Bayat et al. |
| 7,338,189 | B2 | 3/2008 | Kovacik et al. |
| 7,341,363 | B1 | 3/2008 | Richardson |
| 7,367,689 | B2 | 5/2008 | Huang |
| 7,648,261 | B2 | 1/2010 | Ko et al. |
| 7,731,386 | B2 | 6/2010 | Levine |
| D620,627 | S | 7/2010 | Kovacik et al. |
| D622,431 | S | 8/2010 | Bayat et al. |
| D626,673 | S | 11/2010 | Kovacik et al. |
| D641,093 | S | 7/2011 | Kidman |
| 8,038,311 | B2 | 10/2011 | Lau |
| 2005/0265035 | A1 | 12/2005 | Brass et al. |
| 2006/0034091 | A1 | 2/2006 | Kovacik et al. |
| 2006/0198132 | A1 | 9/2006 | Trigiani et al. |
| 2009/0109679 | A1 | 4/2009 | Ko et al. |
| 2010/0177502 | A1 | 7/2010 | Lau |

OTHER PUBLICATIONS

Designer's Edge, "Designers Edge L-2006 Ecozone 65-Watt Fluorescent Portable 360-Degree Worklight", Amazon.com, downloaded Sep. 20, 2011.

Stanley, "Stanley BF0109 BarFlex Work Light", Amazon.com, downloaded Sep. 20, 2011.

Stanley, "Stanley PWL0109 Pivoting Fluorescent Work Light", Amazon.com, downloaded Sep. 20, 2011.

TerraLUX, "TerraLUX TLW-80 WorkStar80 LED Cordless and Rechargable Work Light", Amazon.com, downloaded Sep. 20, 2011.

Ex parte Qualye Office Action dated Oct. 3, 2013 for U.S. Appl. No. 29/433,160, filed Sep. 26, 2012, entitled Utility Work Light.

UTILITY ILLUMINATION DEVICE

CROSS REFERENCE TO RELATED APPLICATIONS

This application is a continuation of U.S. patent application Ser. No. 13/627,844, filed Sep. 26, 2012, entitled "UTILITY ILLUMINATION DEVICE", now allowed, which claims the benefit of U.S. Provisional Patent Application Ser. No. 61/539,140, filed Sep. 26, 2011, entitled "UTILITY ILLUMINATION DEVICE", the disclosures of which are incorporated herein by reference.

BACKGROUND

Various aspects of the present invention relate generally to illumination devices, and more particularly, to adjustable utility illumination devices that can be utilized for diverse applications.

Utility lights are frequently used to cast light into non-illuminated or poorly illuminated locations. For instance, utility lights are often used in work areas to improve lighting so that workers can better see an object or area that is the subject of a particular task. In this regard, a worker may repeatedly handle, move and reposition the utility light, e.g., to redirect the light to an area of interest that requires additional illumination based upon the particular task. Moreover, utility lights are portable devices, which are often designed to operate off of battery power. As such, utility lights also find favor in outdoors areas where electricity is not available to power conventional lights.

BRIEF SUMMARY

According to aspects of the present invention, an illumination device comprises a first end member, a second end member and a light tube coupled between the first end member and the second end member. The first end member has at least two faceted surfaces along a perimeter thereof. Analogously, the second end member has at least two faceted surfaces along a perimeter thereof. The light tube is book-ended between the first end member and the second end member such that the at least two faceted surfaces of the first end member are oriented in an aligned relationship with the at least two faceted surfaces of the second end member.

The illumination device further comprises an illumination assembly that includes a light source positioned within the light tube. Moreover, a knob extends from the second end member and is coupled to at least a section of the illumination assembly such that rotation of the knob causes a corresponding rotation within the light tube to change the direction of light emitted from the illumination device. In an exemplary implementation, a cross section of the light tube is smaller than a cross section of the first end member and a cross section of the second end member. Moreover, the illumination device is positionable on a flat surface such that a select one of the at least two faceted surfaces of each of the first and second end members rests on the flat surface and the light tube is suspended away from surface by the first and second end members.

According to further aspects of the present invention, an illumination device comprises a first end member having at least one faceted surface along an edge thereof and a second end member having at least one faceted surface along an edge thereof. The illumination device further comprises an illumination assembly comprising a light source coupled between the first end member and the second end member. In this manner, the illumination assembly is manually rotatable so as to rotate a pattern of light emitted by the illumination device through a plurality of positions, such that the pattern of light covers 360 degrees when rotated through the plurality of positions.

According to still further aspects of the present invention, an illumination device comprises a first end member having at least one faceted surface along an edge thereof and a second end member having at least one faceted surface along an edge thereof. The illumination device further comprises an illumination assembly comprising a light source, which is coupled between the first end member and the second end member. In this regard, a cross-section of the illumination assembly is smaller than the cross-section of both the first end member and the second end member. The illumination assembly is rotatable about an axis extending between the first and second end members such that manual rotation of the illumination assembly causes a change in the direction of light emitted from the illumination device relative to the stationary positioning of both of the first and second end members.

DETAILED DESCRIPTION

Figure 1:
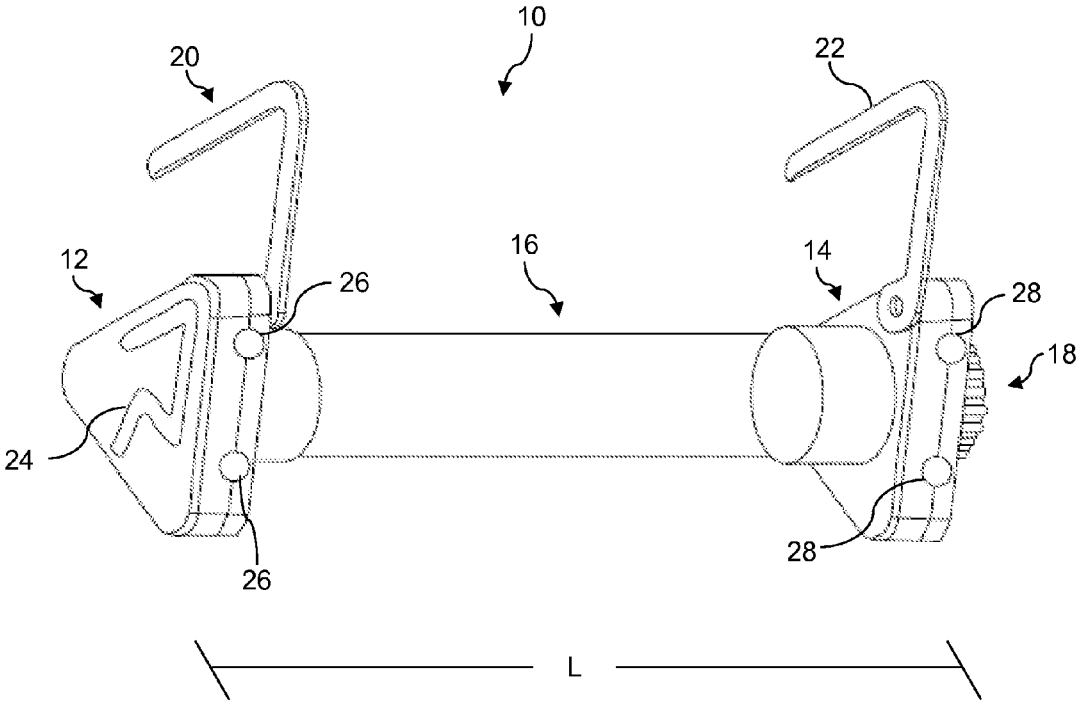
FIG. 1 is a perspective view of an illumination device, according to aspects of the present invention.

Referring now to the drawings, and in particular, to FIG. 1, a utility illumination device 10 (utility work light) is illustrated, according to various aspects of the present invention. In general, the illumination device 10 comprises a first end member 12, a second end member 14, and a light tube 16 disposed between the first end member 12 and the second end member 14. For instance, as illustrated, a first flange extends from an inside major surface of the first end member 12, and a second flange extends from an inside major surface of the second end member 14. The ends of an elongate clear light tube insert into the respective flanges, thus defining a unitary housing having a length (L) that extends longitudinally.

The first end member 12 has at least one faceted surface along an edge thereof. Correspondingly, the second end member 14 has at least one faceted surface along an edge thereof. For instance, as illustrated, the first end member 12 and the second end member 14 have a triangular cross-section, thus defining three faceted surfaces therearound. However, in practice, the first end member 12 and the second end member 14 can take on other shapes, including shapes that comprise polygons, curved portions, etc. As illustrated, the first end member 12 is the same general size and shape as the second end member 14 and the first and second end members 12, 14 are arranged generally, in a "book-end" manner bounding the light tube 16 such that the faceted surfaces are oriented in a cooperative relationship, as will be described in greater detail herein. The light tube 16 allows light from a light source within the light tube 16 to pass therethrough, and may thus comprise any suitable material that is transparent, translucent, etc.

The illumination device 10 in this illustrative example also comprises a knob 18. The knob 18 provides a user adjustable control for directing the light that is emitted from the light tube. As illustrated, the knob 18 extends from an exterior major surface of the second end member 14. The knob 18 further aligns substantially coaxially with the longitudinal length of the light tube 16, and is coupled to at least one component within the light tube 16 such that rotation of the knob 18 causes a corresponding change in the direction of light emitted by the illumination device 10. However, in practice, the knob 18 can be positioned in other locations, so long as adjustment of the knob 18 causes a change in the direction of light emitted from the light tube (or at least a change in the direction of light emitted from the light tube relative to the first and second end members 12, 14).

The illumination device 10 also comprises a first pivot-out hook 20 and a second pivot-out hook 22. The first and second pivot-out hooks 20, 22 facilitate positioning of the illumination device 10 in a number of different positions arranged with the length (L) of the illumination device 10 (in the longitudinal direction) oriented generally horizontally. The pivot-out hooks 20, 22 are described in greater detail herein.

The illumination device 10 also comprises a fold-out hook 24. As illustrated, the fold-out hook 24 is shown in a first folded position generally flush with the exterior major surface of the first end member 12 such that the fold-out hook is generally opposite the knob 18. The fold-out hook 24 facilitates positioning of the illumination device 10 in a number of different positions arranged with the length (L) of the illumination device 10 (in the longitudinal direction) oriented generally vertically. The fold-out hook 24 is also described in greater detail herein.

The illumination device 10 still further comprises a plurality of magnets 26, 28. As illustrated, the magnets 26, 28 are embedded into the first and second end members 12, 14 (respectively), and provide a mechanism to support, hold, hang or otherwise set the illumination device 10 into a position in cooperation with a magnetically attractable surface.

An illumination assembly is positioned within the light tube 16. The illumination assembly includes circuitry, one or more illumination devices, and other hardware for directing light, powering light, emitting light, etc. Details describing various embodiments of the illumination assembly will be described in greater detail herein.

Figure 2:
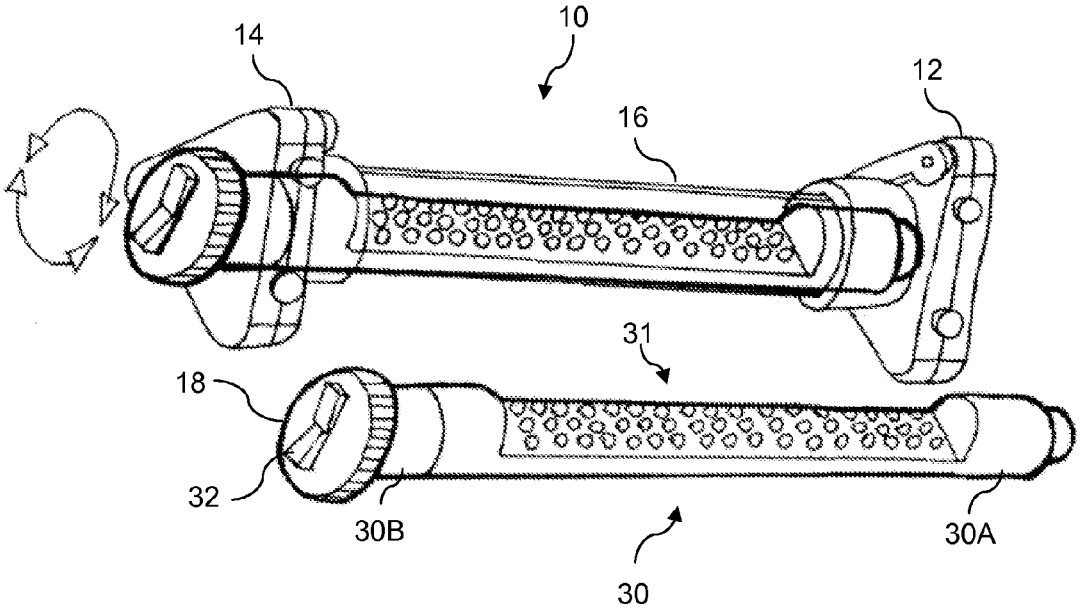
FIG. 2 is a perspective view of an illumination device using light emitting diodes as an illumination source, where an illumination assembly is illustrated both installed within a light tube of the illumination device according to aspects of the present invention, and removed from the illumination device for purposed of clarity of discussion.
Figure 3A:
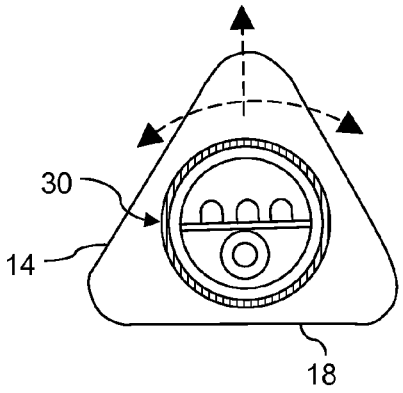
FIGS. 3A-3E are side schematic views of the illumination device of FIG. 2, illustrating the rotation of the illumination source in several exemplary positions.
Figure 3B:
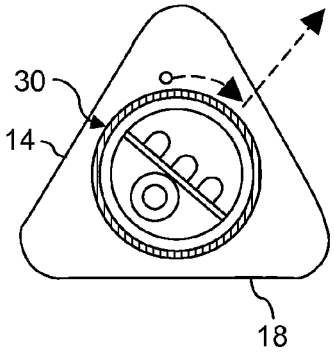
Figure 3C:
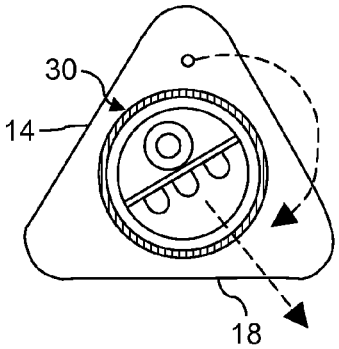
Figure 3D:
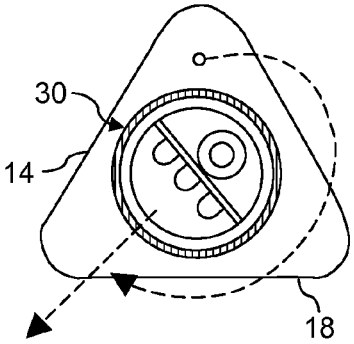
Figure 3E:
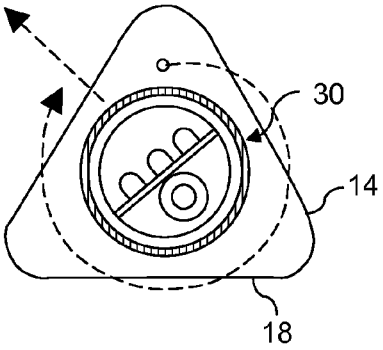

Referring to FIG. 2, an illumination device 10 is illustrated according to various aspects of the present invention. In this Figure, an illumination assembly 30 is illustrated both outside of the illumination device 10, and inside the illumination device for purposes of clarity of discussion. In the illustrative implementation, the illumination assembly 30 includes a light source 31 implemented by a plurality of light emitting diodes (LEDs). The LEDs are arrayed about a carrier that provides the necessary circuitry to hold and power the LEDs during use. Moreover, the illumination assembly includes a housing that couples to the knob 18.

As schematically illustrated, the illumination assembly 30 is generally elongate. A first end 30A of the illumination assembly 30 is journaled for rotation into the flange/inside major surface of the first end member 12. The illumination assembly 30 extends through the light tube 16. A second end 30B of the illumination assembly 30 is correspondingly journaled for rotation into the flange/inside major surface of the second end member 14 and the knob 18 couples to the illumination assembly adjacent to the exterior major surface of the second end member 14. In this regard, the knob 18 extends from the second end member 14 and is coupled to at least a section of the illumination assembly 30 such that rotation of the knob 18 causes a corresponding rotation of the illumination assembly 30 within the light tube 16 so as to change the direction of light emitted from the illumination device 10, e.g., the LEDs in this exemplary implementation. An optional light switch 32 is provided on the knob 18 in the illustrated example, to turn the light source 31 on/off.

Referring to FIGS. 3A-3E, a series of schematic side views illustrate manual rotation of the knob 18 to allow a user to select a fixed position of emitted light from the illumination device 10. As is illustrated, rotation of the knob 18 rotates the carrier, and hence the LEDs into different positions. The LEDs are shown as a plurality of rows of three adjacent light devices mounted to a carrier, e.g., a circuit board. However, in practice, any number of LEDs, e.g., one or more LEDs can be utilized in practice. A battery power source is also illustrated below the carrier to demonstrate that illumination assembly 30 can also serve as a battery compartment. As such, one or more batteries, if provided in the illumination assembly 30, rotate with the LEDs.

The knob 18 may rotate the LEDS (and optionally, the battery power) as much as 360 degrees. Alternatively, the knob 18 can rotate the LEDS between some range less than 360 degrees. Moreover, the knob 18 may rotate continuously (i.e., in an endless rotation in either direction). As yet a further example, the knob 18 may rotate to discrete positions, e.g., detents that program a direction of light at designated positions relative to the first and second end members 12, 14.

Figure 4:
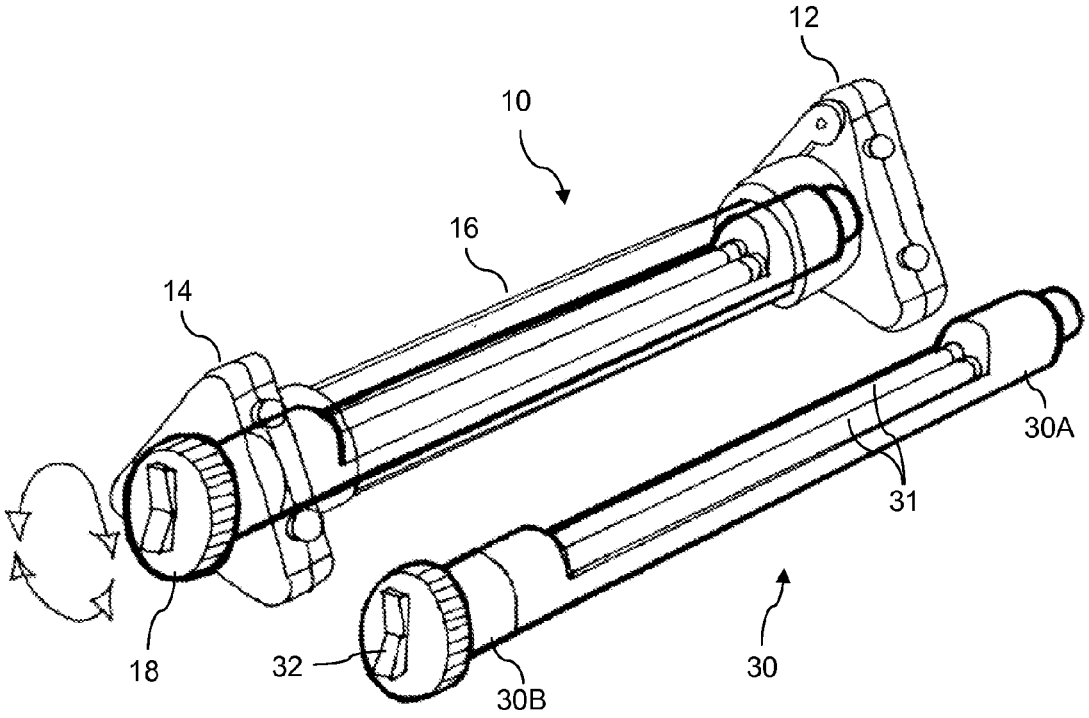
FIG. 4 is a perspective view of an illumination device using fluorescent bulbs as an illumination source, where an illumination assembly is illustrated both installed within a light tube of the illumination device according to further aspects of the present invention, and removed from the illumination device for purposes of clarity of discussion herein.
Figure 5A:
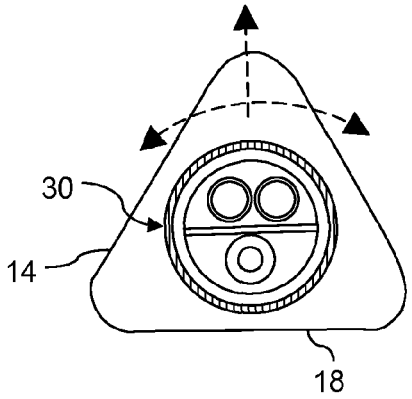
FIGS. 5A-5E are side schematic views of the illumination device of FIG. 4, illustrating the rotation of the illumination source in several exemplary positions.
Figure 5B:
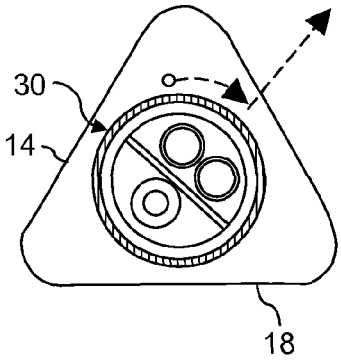
Figure 5C:
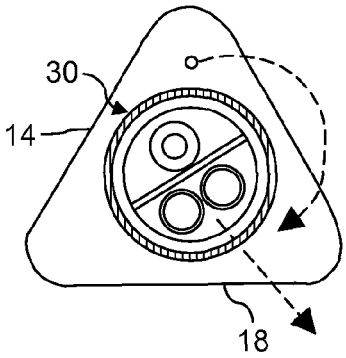
Figure 5D:
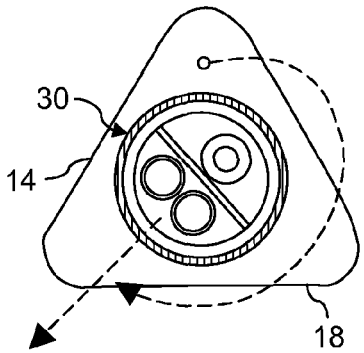
Figure 5E:
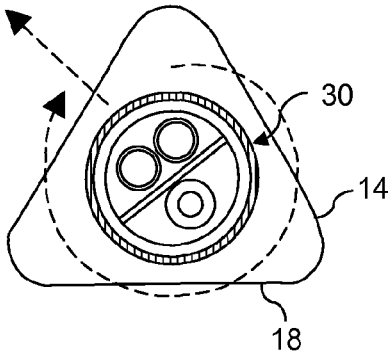

Referring to FIG. 4, an illumination device 10 is illustrated according to further aspects of the present invention. In this implementation, the illumination device 10 is analogous to the illumination device of FIGS. 2 and 3A-3E, except that the light source 31 is implemented using at least one bulb. The illumination assembly 30 as shown holds two fluorescent bulbs, although other configurations can alternatively be implemented. Thus, the illumination assembly 30 includes bulb fixtures, electronics and other electrical components necessary to operate the bulbs. In a manner analogous to FIG. 2, two instances of the illumination assembly 30 are shown, one instance external to the light tube 16, and a second instance installed within the light tube 16. This is for purposes of clarity of discussion only. In practice, only one illumination assembly 30 is installed between the first and second end members 12, 14.

As schematically illustrated, the illumination assembly 30 is generally elongate. A first end 30A of the illumination assembly 30 is journaled for rotation into the flange/inside major surface of the first end member 12. The illumination assembly 30 extends through the light tube 16. A second end 30B of the illumination assembly 30 is correspondingly journaled for rotation into the flange/inside major surface of the second end member 14 and the knob 18 couples to the illumination assembly adjacent to the exterior major surface of the second end member 14. In this regard, the knob 18 extends from the second end member 14 and is coupled to at least a section of the illumination assembly 30 such that rotation of the knob 18 causes a corresponding rotation of the illumination assembly 30 within the light tube 16 so as to change the direction of light emitted from the illumination device 10, e.g., the light bulb(s) in this exemplary implementation. An optional light switch 32 is provided on the knob 18 in the illustrated example, to turn the light source 31 on/off.

Referring to FIGS. 5A-5E, a series of schematic side views illustrate manual rotation of the knob 18 to allow a user to select a fixed position of emitted light from the illumination device 10. As is illustrated, rotation of the knob 18 rotates the carrier, and hence the fluorescent bulb(s) into different positions so as to change the direction of light emitted from the illumination device 10. The knob 18 may rotate the fluorescent bulbs as much as 360 degrees. Alternatively, the knob 18 can rotate the fluorescent bulbs between some range less than 360 degrees. In this manner, the operation of the knob 18 may be analogous to that described more fully above with reference to FIGS. 3A-3E. The bulbs are shown as two adjacent light devices mounted above a carrier. A battery power source is also illustrated below the carrier to demonstrate that the illumination assembly 30 can also serve as a battery compartment. Accordingly, one or more batteries, if provided in the illumination assembly 30, rotate with the bulbs.

Figure 6:
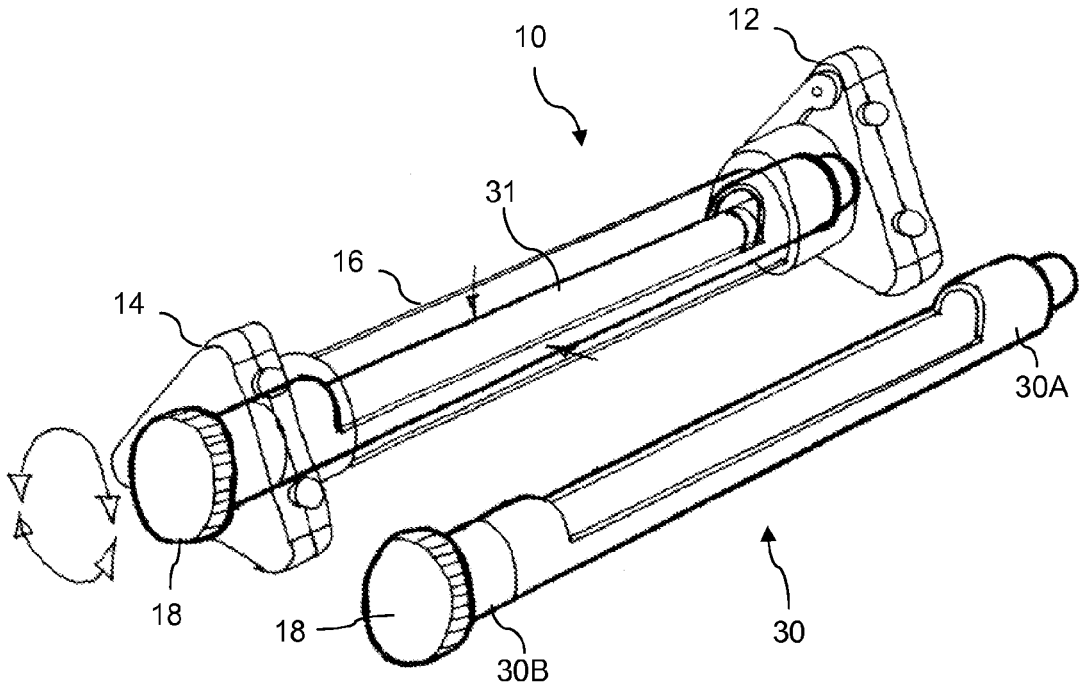
FIG. 6 is a perspective view of an illumination device using a reflector that is rotatable about a light source, where an illumination assembly is illustrated both installed within a light tube of the illumination device according to still further aspects of the present invention, and removed from the illumination device for purposes of clarity of discussion herein.
Figure 7A:
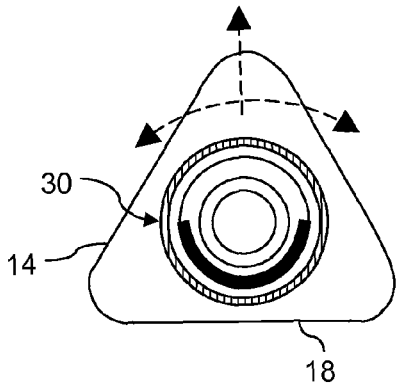
FIGS. 7A-7E are side schematic views of the illumination device of FIG. 6, illustrating the rotation of the reflector in several exemplary positions.
Figure 7B:
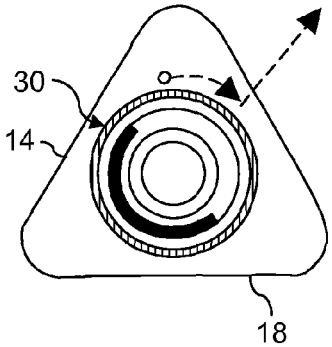
Figure 7C:
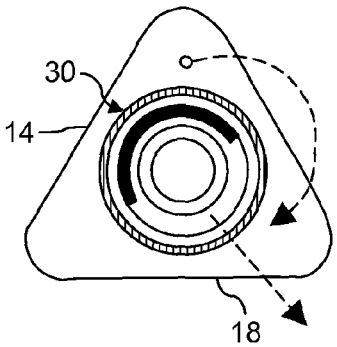
Figure 7D:
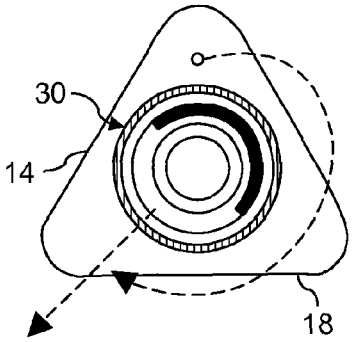
Figure 7E:
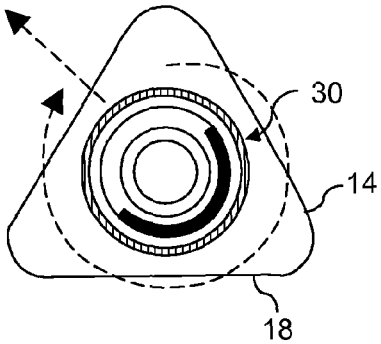

Referring to FIG. 6, an illumination device 10 is illustrated according to still further aspects of the present invention. In this regard, the illumination device 10 is analogous to the illumination device of FIGS. 4 and 5A-5E, except that the illumination assembly includes a reflector that is rotated about a stationary light source 31, e.g., one or more stationary bulbs. One bulb is illustrated for purposes clarity. The illustrated illumination device 10 thus includes bulb fixtures, electronics and other electrical components necessary to operate the bulb(s) as described above, except that the bulb is fixed and does not rotate relative to the first and second end members 12, 14 and light tube 16.

The illumination assembly 30 is illustrated both outside of the illumination device 10, and inside the illumination device for purposes of clarity of discussion. In a manner analogous to that of FIG. 2, the illumination assembly 30 (implemented as a reflector in this embodiment) is generally elongate. A first end 30A of the illumination assembly 30 is journaled for rotation into the flange/inside major surface of the first end member 12. The illumination assembly 30 extends through the light tube 16 and corresponding light source 31. A second end 30B of the illumination assembly 30 is correspondingly journaled for rotation into the flange/inside major surface of the second end member 14 and the knob 18 couples to the illumination assembly adjacent to the exterior major surface of the second end member 14. In this regard, the knob 18 extends from the second end member 14 and is coupled to at least a section of the illumination assembly 30 such that rotation of the knob 18 causes a corresponding rotation of the illumination assembly 30 within the light tube 16 so as to rotate the reflector around the light source 31, and thus to change the direction of light emitted from the illumination device 10.

In this implementation, the illumination source may emit light radially out substantially in all directions. However, the direction of light allowed to exit the illumination device itself, is controlled by manually rotating the reflector to a desired position, thus directing the light in a defined pattern.

Referring to FIGS. 7A-7E, a series of schematic side views illustrate manual rotation of the knob 18 to allow a user to select a fixed position of emitted light from the illumination device 10. As is illustrated, rotation of the knob 18 rotates the reflector into different positions so as to change the direction of light emitted from the illumination device 10. In this regard, the knob 18 may rotate the reflector as much as 360 degrees. Alternatively, the knob 18 can rotate the reflector between some range less than 360 degrees. In this manner, operation of the knob 18 can be implemented in a manner analogous to that set out in FIGS. 3A-3E and/or 5A-5E.

Figure 8:
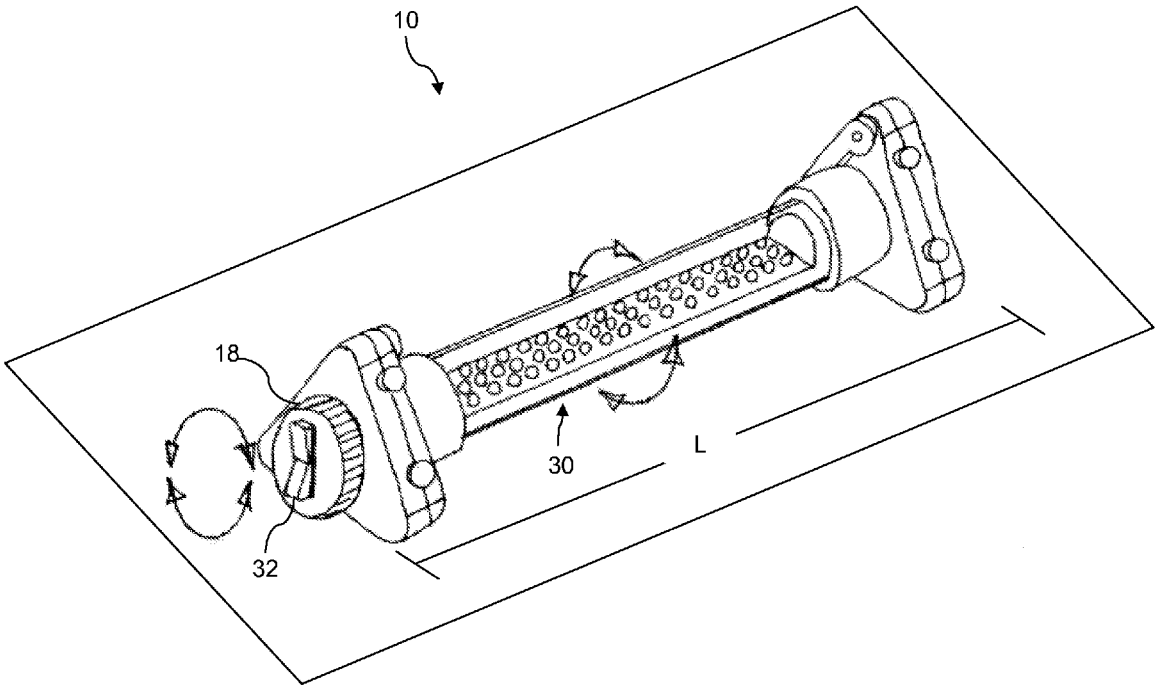
FIG. 8 is a perspective view of an illumination device resting horizontally on a surface, according to further aspects of the present invention.

Referring to FIG. 8, an exemplary implementation of an illumination device 10 is illustrated, according to aspects of the present invention. In the illustrative implementation, a power switch 32 is disposed on the end of the knob 18. The power switch 32 is operable to turn an illumination source on or off. The illustrated illumination assembly 30 comprises a plurality of light emitting diodes (LEDs) arrayed on a circuit board. The power switch 32 can thus be utilized to turn the LEDs on and off. However, bulbs can alternatively be implemented, as described more fully herein.

As the knob 18 is rotated, the illumination assembly 30 (or components thereof) rotate is cooperation with the knob 18. However, the first and second end members 12, 14 remain stationary relative to the rotation of the knob 18. Accordingly, the direction of light emitted by the illumination device 10 can be manually altered by a user without physically repositioning the illumination device itself.

As illustrated, the illumination device 10 is in a position where the longitudinal length is horizontal. Additionally, as noted above, the first and second end members 12, 14 each include at least one faceted surface along the edges thereof. Moreover, the faceted edges of the first and second end members 12, 14 are coordinated. As such, the illumination device 10 can rest on a surface such that a faceted edge of each of the first and second end members 12, 14 rests on the surface and the illumination assembly 30 is supported above the surface by the first and second end members 12, 14, as is illustrated. In this manner, the illumination device 10 is stable, even where a user is rotating the knob 18 so as to change the direction of light emitted by the illumination device 10.

Accordingly, the faceted surface of the first end member 12 defines a support surface that allows the illumination device 10 to rest on a support surface in a first position. Similarly, the faceted surface of the second end member 14 defines a support surface that allows the illumination device to rest on the support surface in the first position such that the illumination device 10 contacts the surface at two discrete, spaced apart locations of contact, which are spaced apart by the light tube 16 in this example.

Also, as illustrated, the first and second end members 12, 14 have a cross-section that is larger than the cross-section of the light tube 16. In this regard, the cross-section is taken along a plane that is orthogonal to the longitudinal length (L). As such, the illumination device 10 can be slid, moved or otherwise repositioned around a work surface without damaging the light tube 16, or inadvertently changing the light pattern orientation. In alternative embodiments, the cross section of the first and second end members 12, 14 need not be larger than the cross-section of the light tube 16.

Figure 9:
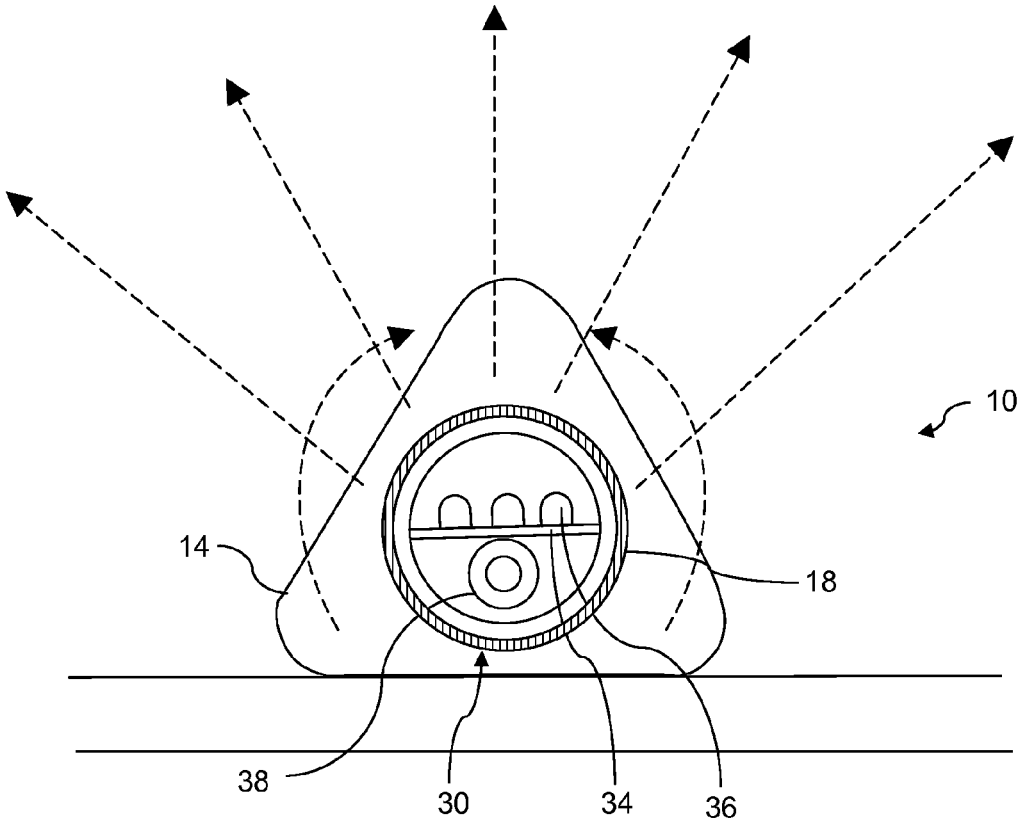
FIG. 9 is a side view of the illumination device of FIG. 8, illustrated in a resting position and demonstrating an ability to direct light in multiple, user-selected directions, according to aspects of the present invention.

Referring to FIG. 9, an end view of the illumination device of FIG. 8 is illustrated according to aspects of the present invention. Because of the faceted features of the first and second end members (only the second end member 14 is illustrated in FIG. 9), the illumination device 10 is stable. In the illustrative implementation, the illumination assembly 30 includes a generally planar carrier 34, e.g., a circuit board, which contains a plurality of LEDs 36. One or more batteries 38 are positioned underneath the carrier 34 generally opposite the LEDs 36. In this arrangement, a reflector many not be necessary or required as the orientation of the LEDs 36 in an array on the flat (or alternatively curved) carrier 34 will serve to limit the dispersion pattern of light emitted by the LEDS 36. Alternatively, a reflector or reflectors may be utilized, as will be described in greater detail below.

Moreover, as discussed in greater detail herein, manual rotation of the knob 18 by a user causes corresponding rotation of the illumination assembly 30 so that rotation of the knob 18 changes the direction of the light emitted by the illumination device 10 by changing the orientation of the carrier 34, and hence the LEDs 36, relative to the first and second end members 12, 14. Thus, a user can target light to an intended area of interest. In FIG. 9, emitted light is schematically represented by dashed lines extending from the illumination device 10.

Figure 10:
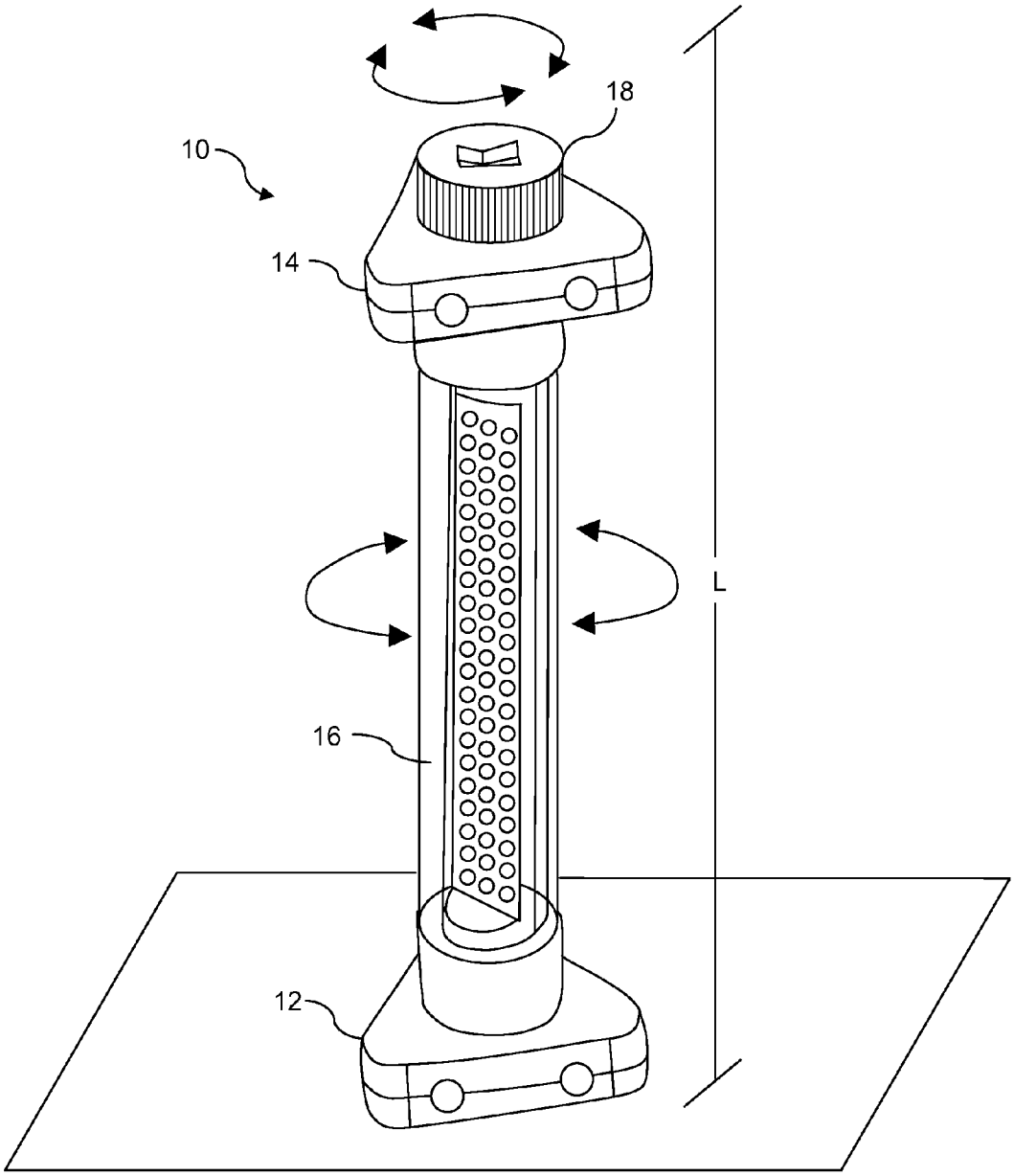
FIG. 10 is a perspective view of the illumination device of FIG. 8, resting vertically on a major surface of a faceted end member, according to still further aspects of the present invention.

Referring to FIG. 10, the illumination device 10 of FIG. 8 is illustrated in a vertical position. That is, the longitudinal length (L) of the illumination device 10 extends vertically to demonstrate another exemplary working position of the illumination device 10. Because the exterior major surface of the first end member 12 is substantially flat and because the fold-out hook (not illustrated in FIG. 10) is folded flush with the exterior major surface, the first end member 12 defies a sturdy base for orienting the illumination device 10 in a vertical position. Again, because of the unencumbered access to the knob 18, a user can readily change the direction of light emitted from the illumination device 10 without affecting the stability of the illumination device 10, even when the illumination device 10 is free-standing in a vertical orientation.

Figure 11:
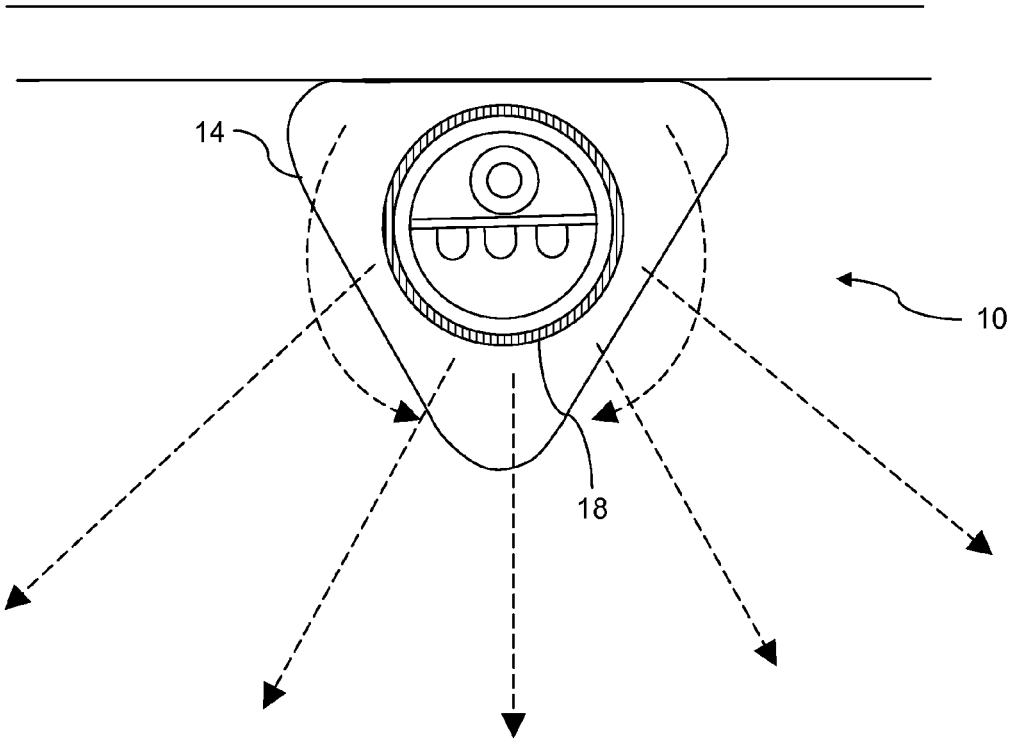
FIG. 11 is a side view of the illumination device of FIG. 8, illustrated in a hanging position, demonstrating an ability to direct light in multiple, user-selected directions, according to aspects of the present invention.

Referring to FIG. 11, because the first and second members 12, 14 include magnets 26, 28, respectively (e.g., along at least one faceted edge thereof), the illumination device 10 can attach to surfaces that are capable of magnetic attraction with the magnets 26, 28. Moreover, the faceted surfaces of the first and second end members 12, 14, respectively, facilitate stable placement of the illumination device 10, even when hanging, e.g., underneath a surface such as a shelf, etc. The magnetic attraction is strong enough to hold the illumination device 10 in a fixed position, allowing a user to turn the knob 18 to change the direction of the light emitted from the device 10 without compromising the stability of the magnetic coupling. In FIG. 11, the light emitted from the illumination device 10 is schematically illustrated by the dashed lines.

Figure 12:
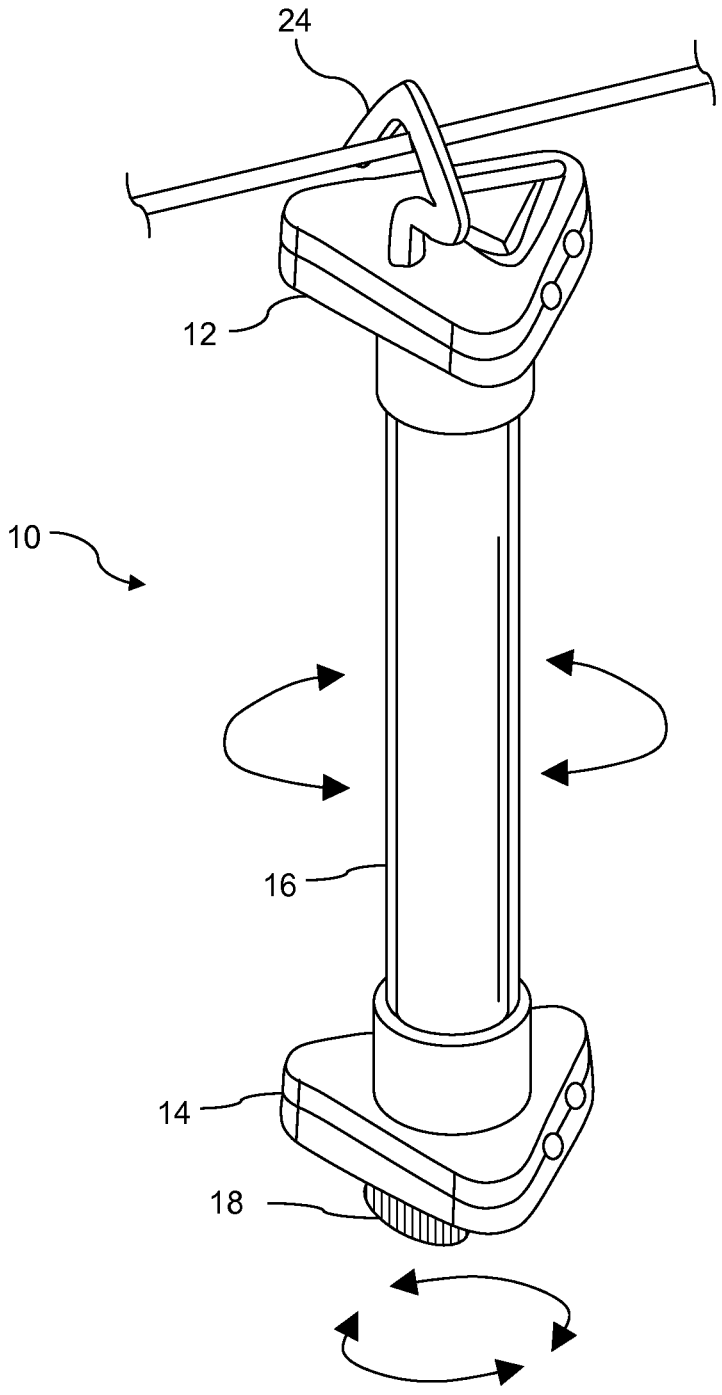
FIG. 12 is an illustration of an illumination device, e.g., such as the illumination device of any one of FIGS. 1-11, which includes a fold-out hook and the ability to direct light in multiple, user-selected directions, according to aspects of the present invention.
Figure 13:
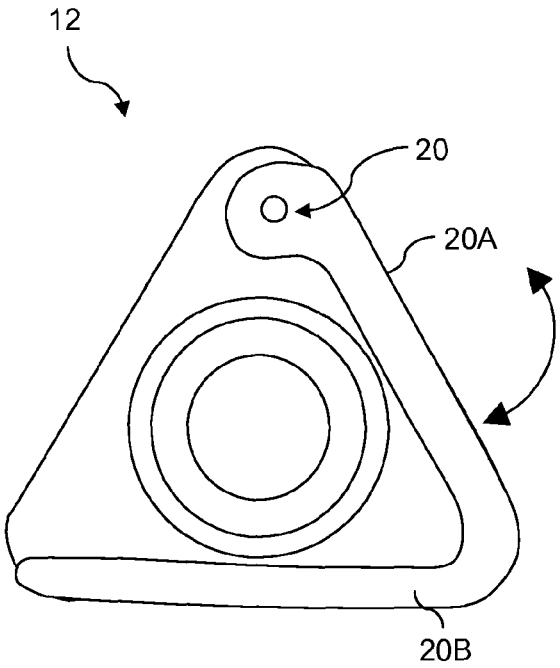
FIG. 13 is a side view of an illumination device, e.g., such as the illumination device in any one of FIGS. 1-12, which includes "pivot-out" hooks, according to aspects of the present invention.

Referring to FIG. 12, in yet another alternative configuration, the fold-out hook 24 can be folded out so as to facilitate hanging the illumination device 10 such that the length of the illumination device (L) extends generally vertically. In this regard, a user can grasp the fold-out hook 24 from a first position recessed into the exterior major surface of the illumination device 10, and the user can pivot the fold-out hook 24 to a second position. As with previous examples, rotation of the knob 18 causes a corresponding change in the direction of light emitted from the illumination device 10. Again however, the change in the direction of emitted light is carried out without changing the position or location of the illumination device 10, and in particular, the first and second end members 12, 14. This can be seen because the rotation occurs to the light source within the light tube 16.

The exterior major surface of the first end member 12 includes a contoured recess that allows the fold-out hook 24 to pivot down so that the exterior major surface of the first end member 12 is substantially flat when the fold-out hook 24 is in a default position. In an exemplary implementation, the fold-out hook 24 has a shape that is conformal to at least a portion of the periphery of the first end member 24, e.g., the fold-out hook 24 generally follows the contour of the triangular cross-section of the first end member 12.

According to aspects of the present invention, the fold-out hook 24 is operable between a first position generally flush with the major surface of the first end member 12 and a second position folded out so as to extend in a direction perpendicular to the major surface of the first end member 12. That is, when folded out to the second position, the fold-out hook 24 extends from the exterior major surface of the first end member 12 so as to extend generally in the longitudinal direction.

With reference to FIGS. 13, 14, 15 and 16 generally, the first pivot-out hook 20 is pivotally coupled to the first end member 12 and the second pivot-out hook 22 is pivotally coupled to the second end member 14. As illustrated in a non-limiting but exemplary implementation, the first end member 12 is triangular in cross-section. As such, the first end member 12 has a cross-sectional shape that includes a first corner, and the first pivot-out hook 20 is pivotally coupled to the first end member 12 proximate to the first corner adjacent to an inside major surface thereof. The first pivot-out hook 20 may also comprise a hook arm that conformally follows the contour of a portion of the first end member 12. Analogously, the second end member 14 has a cross-sectional shape that includes a first corner, and the second pivot-out hook 22 is pivotally coupled to the second end member 42 proximate to the first corner adjacent to an inside major surface thereof. The second pivot-out hook 22 may also comprise a hook arm that conformally follows the contour of a portion of the second end member 14.

In this exemplary implementation, the first pivot-out hook 20 includes two arm components 20A and 20B. When the first pivot-out hook 20 is in a position pivoted flush with the first end member 12, the first arm 20A is positioned adjacent to the inside major surface of the first end member 12 along a first edge 12A, and the second arm 20B is positioned adjacent to the inside major surface of the first end member 12 along a second edge 12B.

Analogously, in this exemplary implementation, the second pivot-out hook 22 includes two arm components 22A and 22B. When the second pivot-out hook 22 is in a position pivoted flush with the second end member 14, the first arm 22A is positioned adjacent to the inside major surface of the second end member 14 along a first edge 14A, and the second arm 22B is positioned adjacent to the inside major surface of the second end member 14 along a second edge 14B.

Figure 14:
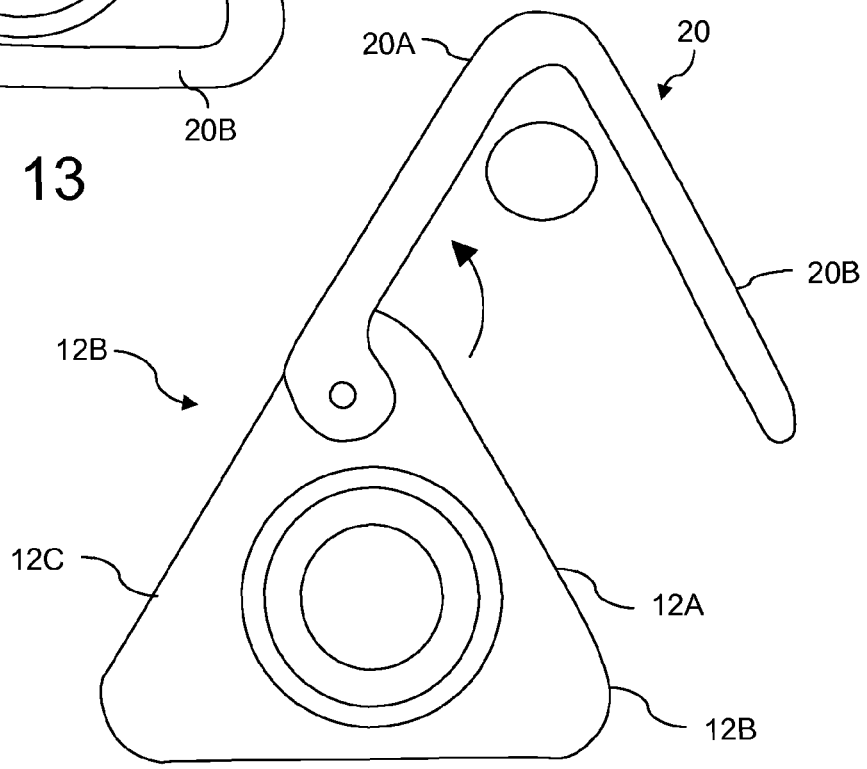
FIG. 14 is a side view of the illumination device of FIG. 13, illustrating the pivot-out hooks transitioned to a first "pivoted out" position so as to suspend the illumination device in a hanging position, according to aspects of the present invention.
Figure 15:
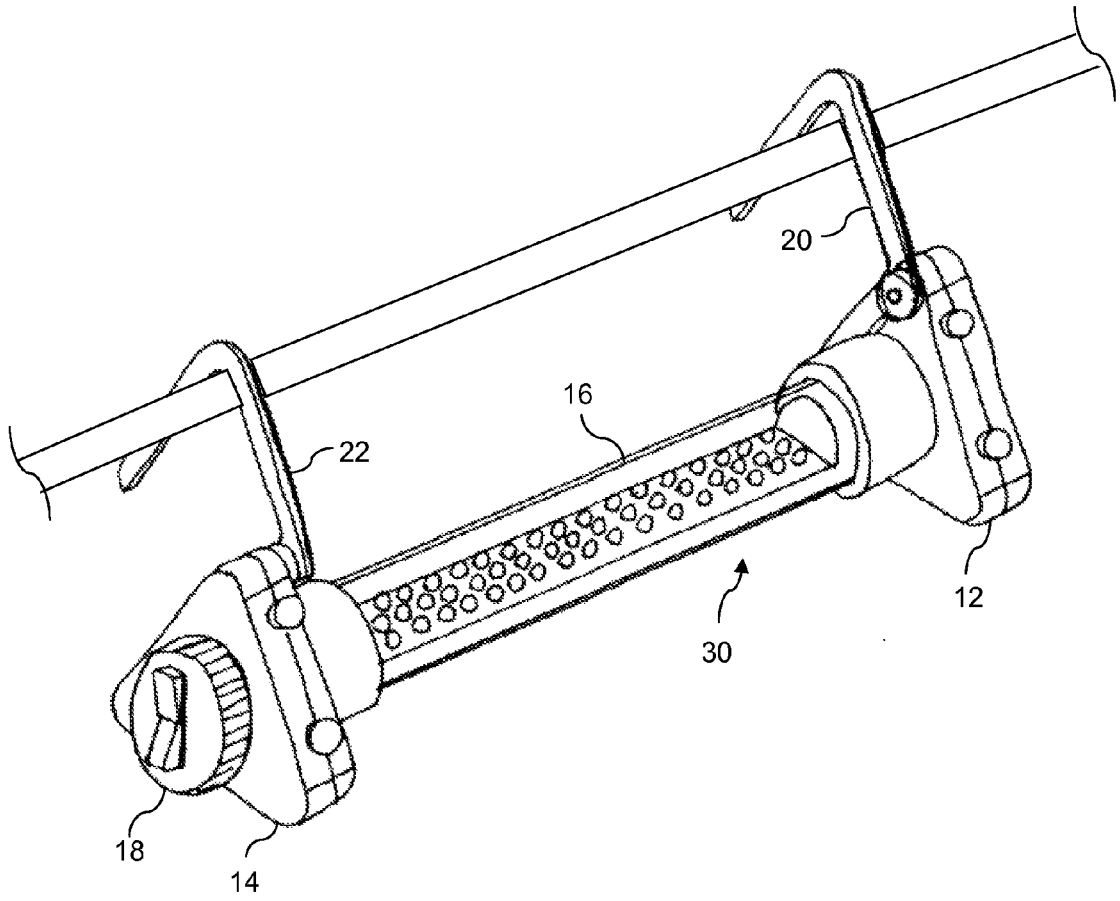
FIG. 15 is a perspective view of the illumination device of FIG. 13, illustrating the pivot-out hooks pivoted out and suspending the illumination device in a hanging position, according to aspects of the present invention.

The pivot-out hooks 20, 22 can pivot out to an appropriate angle for suspending the illumination device 10. For instance, as best illustrated in FIGS. 14 and 15, the pivot-out hooks 20, 22 are pivoted out so that the angle formed by the first and second arm members 20A, 20B form an apex from which the illumination device 10 can hang from a horizontal pole, rod or similar object. For instance, as illustrated, the first arm 20A is substantially parallel with the edge 12C of the first end member 12 in the position illustrated in FIG. 14.

Referring to FIG. 15, an illumination device 10 is illustrated according to various aspects of the present invention. As illustrated, the first and second pivot-out hooks 20, 22 are in a position pivoted out from their respective first and second end members 12, 14, respectively. In the illustrative implementation, the first and second end members 12, 14 are illustrated as having a generally triangular shape. The first pivot-out hook 20 is pivotally coupled to the inside major surface of the first end member 12, generally towards an apex. Moreover, the first pivot-out hook 20 is generally conformal to the periphery of at least a portion of the first end member 12. Analogously, the second pivot-out hook 22 is generally conformal to the periphery of at least a portion of the second end member 14.

Figure 16:
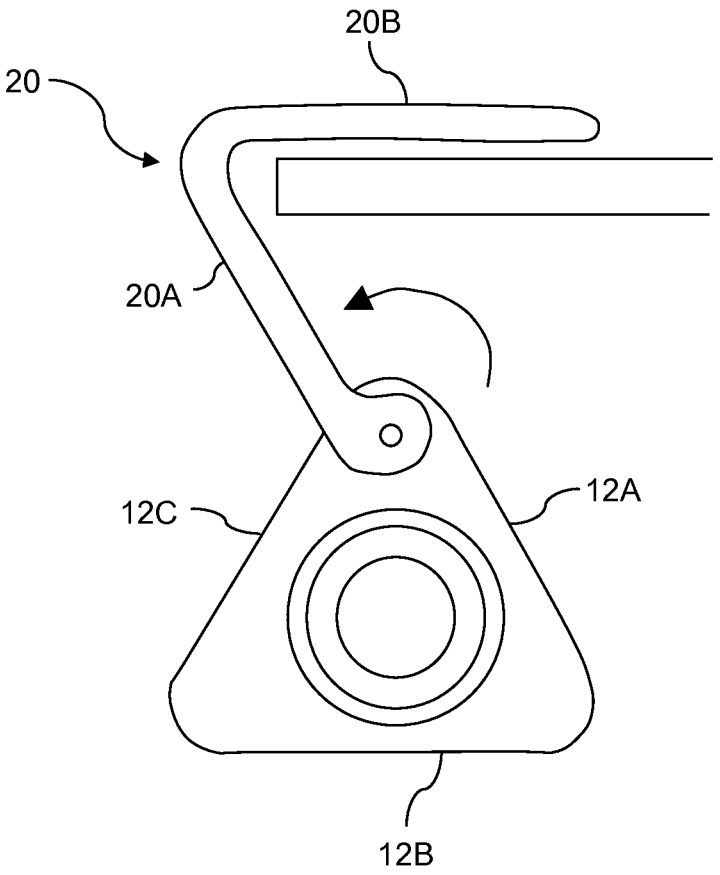
FIG. 16 is a side view of the illumination device of FIG. 13, illustrating the pivot-out hook transitioned to a second "pivoted out" position such that the illumination device is suspended in a hanging position, according to yet further aspects of the present invention.

Referring to FIG. 16, by pivoting the first and second pivot-out hooks 20, 22 further, the second arm, e.g., arm 20B as illustrated, can be oriented generally horizontally. In this regard, the hook arm, e.g., the second arm 20B, 22B, includes at least one flat edge for resting on a flat surface. As such, the pivot-out hooks 20, 22 can be utilized to suspend the illumination device 10 from a flat surface, e.g., a shelf.

According to further aspects of the present invention, the first and second pivot-out hooks 20, 22 can be pivotally secured to the first and second end members 12, 14 respectively, using detents, a ball and spring, or other suitable structure to facilitate discrete positions. This can be useful, for example, to keep the hooks stationary while the illumination device 10 is moved about. Moreover, such devices can be useful, for instance, to provide a tactile response or other user feedback such as a positive click as the pivot-out hooks 20, 22 are pivoted into predetermined positions. As an example, three discrete positions may be provided, including a pivoted back or closed position, a half position as illustrated in FIGS. 14 and 15, and a fully extended position as per FIG. 16.

Figure 17:
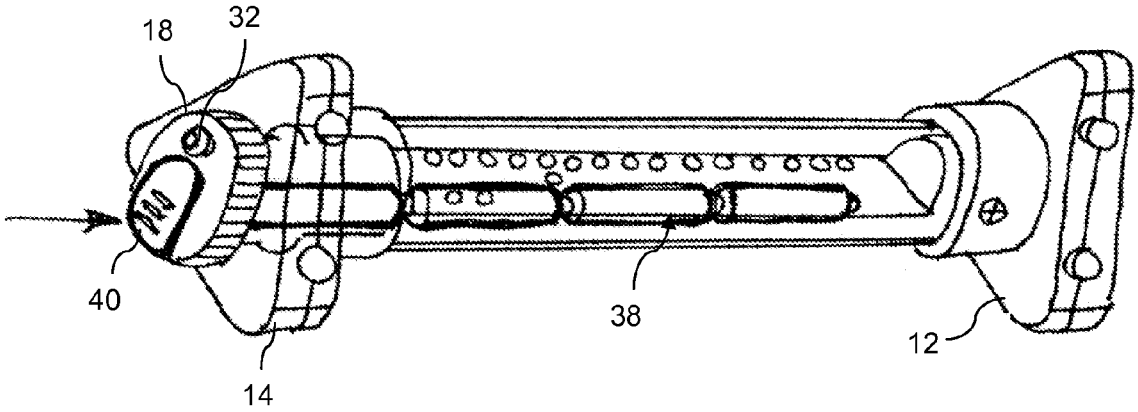
FIG. 17 is a schematic view of an illumination device of FIG. 13, illustrating batteries stored within the illumination device, according to aspects of the present invention.

Referring to FIG. 17, the power button 32 is illustrated in a slightly smaller form than that of the previous figures to make room on the knob 18 for a battery compartment cover 40. The battery compartment cover 40 provides a convenient and fast access a battery compartment that houses the batteries 38 stored within the illumination device 10 for powering the illumination source.

Figure 18:
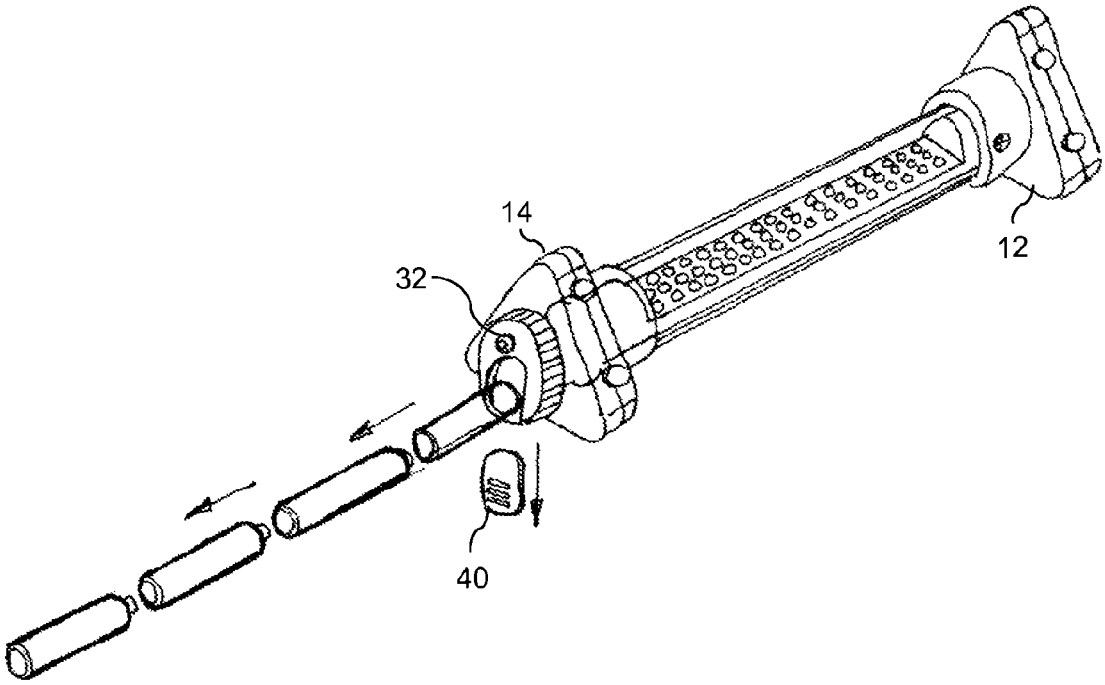
FIG. 18 is a schematic view of the illumination device of FIG. 17, illustrating the removal of batteries from the illumination device, according to aspects of the present invention.

Referring to FIG. 18, a schematic view illustrates the battery compartment cover 40 removed from the knob 18 so that batteries can be removed from the illumination device 10.

Figure 19A:
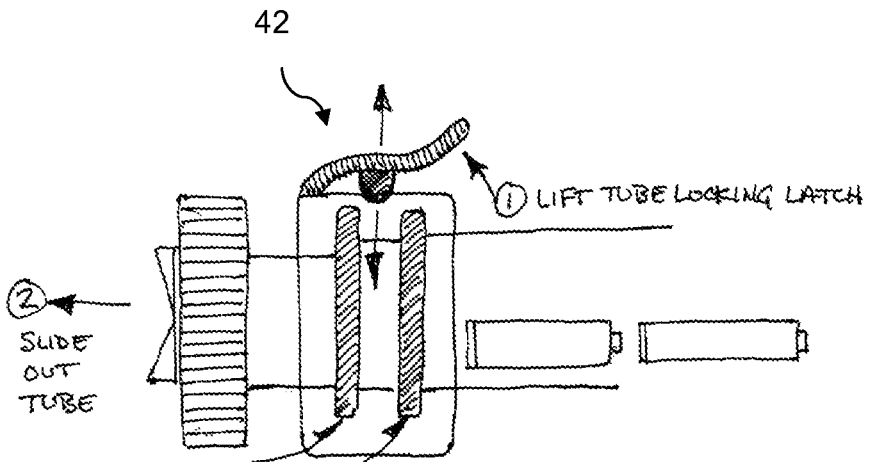
FIGS. 19A-19B are schematic views of a battery compartment for any of the illumination devices of FIGS. 1-16, according to still further aspects of the present invention.
Figure 19B:
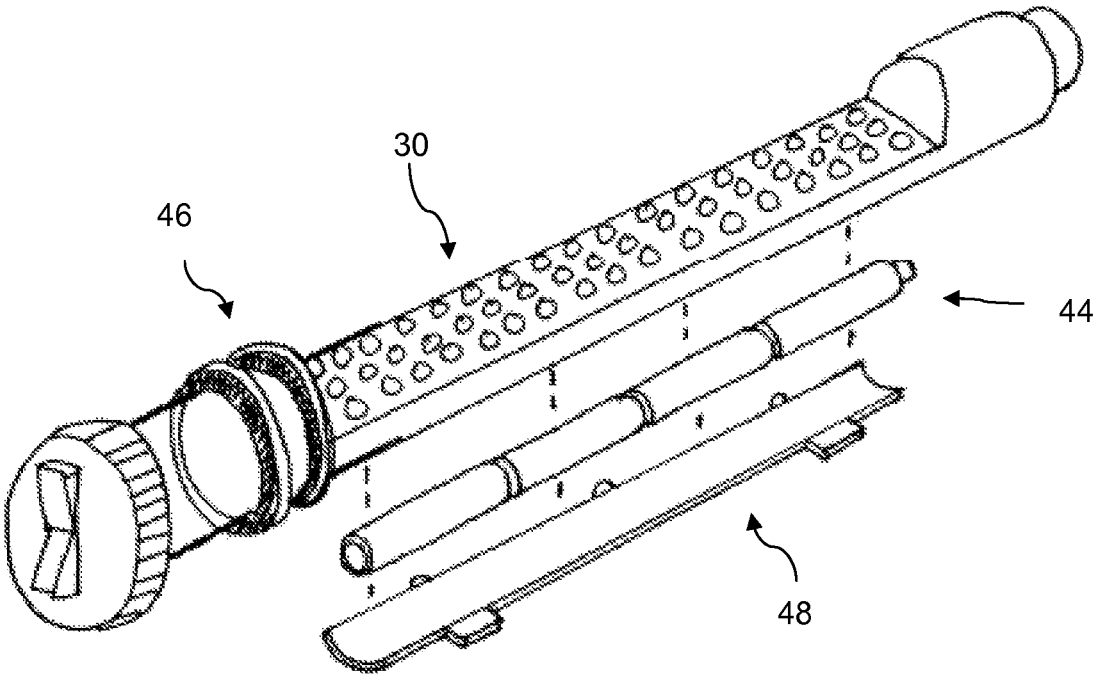

Referring to FIGS. 19A-19B, according to still further aspects of the present invention, the illumination device 10 can include a tube locking latch 42 to access a battery compartment 44. A double ring 46 on the illumination assembly 30 catches the latch. Under this arrangement, the illumination assembly 30 slides out from the second end member 14. The user can then remove a battery cover door 48 or other structures that hold the batteries in place within the illumination assembly 30 to replace the batteries. The user then replaces the battery cover door 48 onto the illumination assembly housing, and inserts the illumination housing back into the light tube through the second end member 14 until the tube locking latch 42 catches on the double ring 46.

Figure 20:
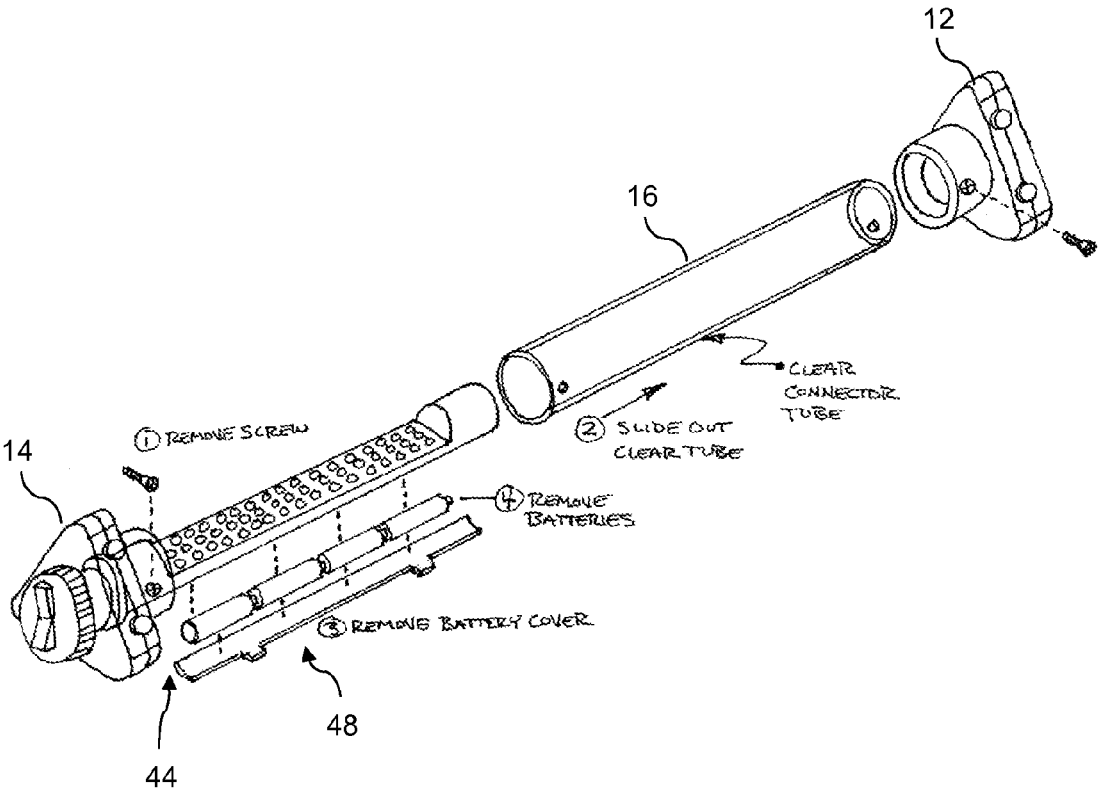
FIG. 20 is a schematic view of a battery compartment for any of the illumination devices of FIGS. 1-16, according to yet further aspects of the present invention.

Referring to FIG. 20, an illumination device 10 is illustrated according to still further aspects of the present invention. As illustrated, a user accesses a battery compartment 44 within the illumination housing 30 by removing at least one screw that secures the light tube to a flange extending from the inside major surface of the first end member 12, second end member 14 or both. Once the screw(s) are removed, the end member(s) can be separated from the light tube 16, and the illumination assembly 30 can be removed from the light tube 16. Once this is accomplished, the battery cover 48 is removed from the illumination assembly 30, the batteries are replaced and the device is re-assembled.

With reference to FIGS. 17 through 20 generally, the light source of the illumination assembly comprises a plurality of light emitting diodes. The light emitting diodes are mounted on a carrier that is rotatably mounted within the light tube and is coupled to the knob as described more fully herein. Moreover, a battery compartment is defined within the light tube and/or illumination assembly such that the carrier divides the batteries from the light emitting diodes.

Figures 21A, 21B, 21C:
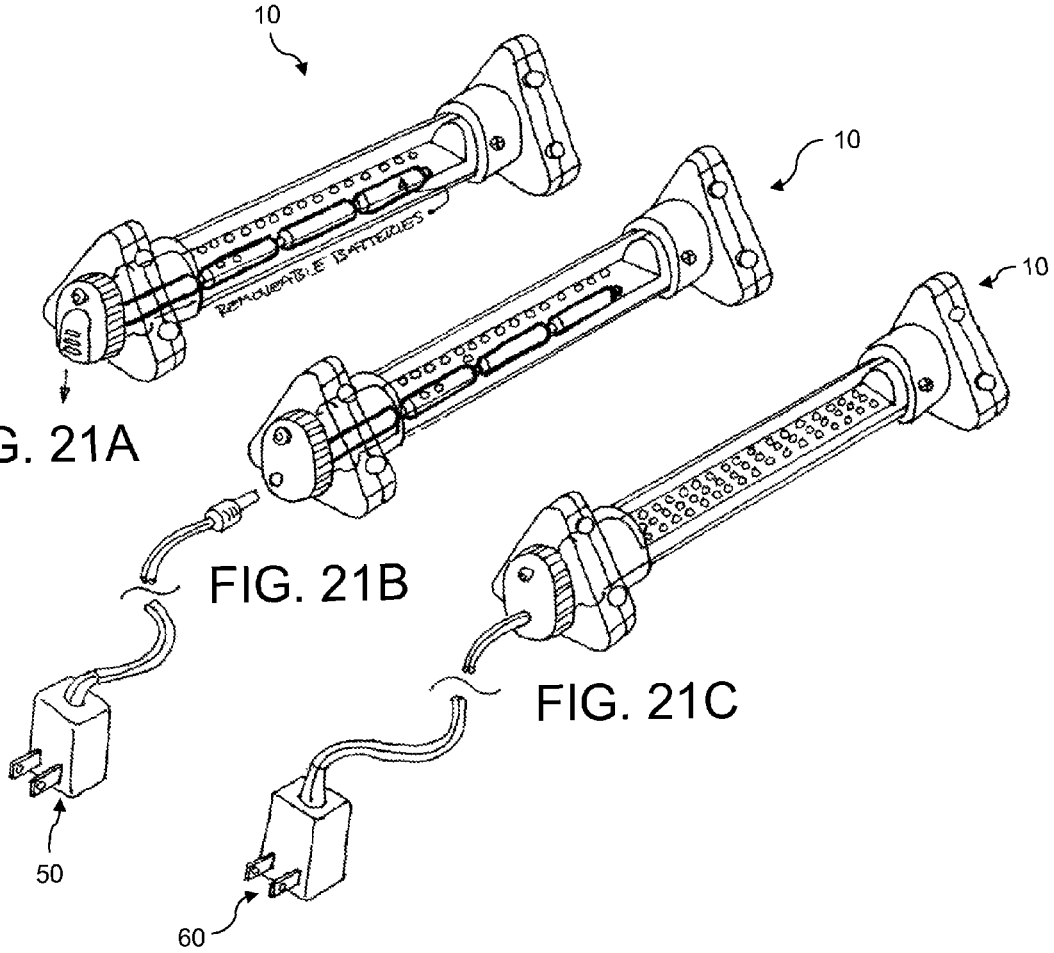
FIG. 21A-21C is a schematic view of various approaches to power an illumination device according to any of the preceding Figures.

FIGS. 21A-21C illustrate multiple exemplary ways to power an illumination device, according to aspects of the present invention, including battery (FIG. 21A), a cord 50 that uses AC wall power to charge rechargeable batteries within the illumination device 10 (FIG. 21B), and a version of the illumination device that operates off of AC power via a power cable 60 (FIG. 21C).

Figure 22:
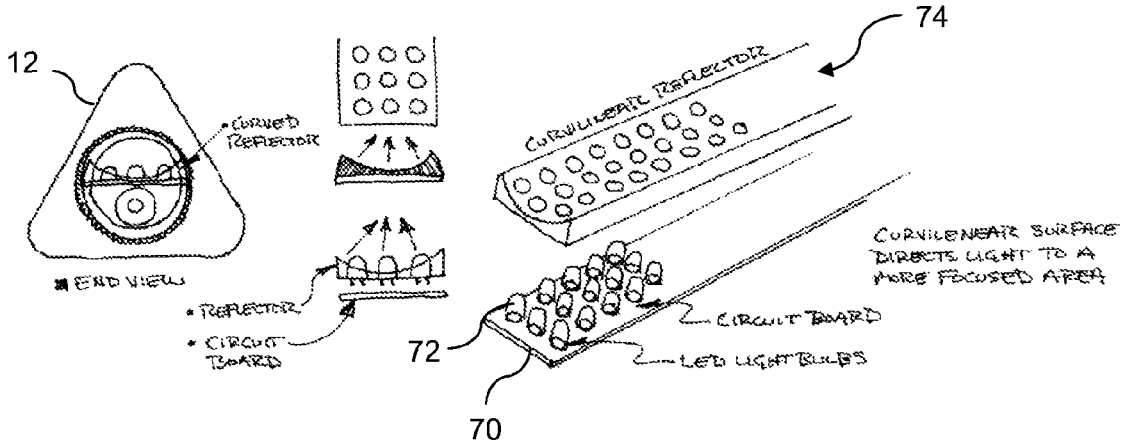
FIG. 22 is a schematic view of a reflector for light emitting diodes, according to various aspects of the present invention.

Referring to FIG. 22, an exemplary implementation of a reflector for an LED implementation is illustrated, according to various aspects of the present invention. As illustrated, a carrier 70, e.g., a circuit board, is populated by a plurality of LEDs 72. A curvilinear reflector 74 is defined by a generally elongate concave channel that directs light to a more focused area.

Figure 23:
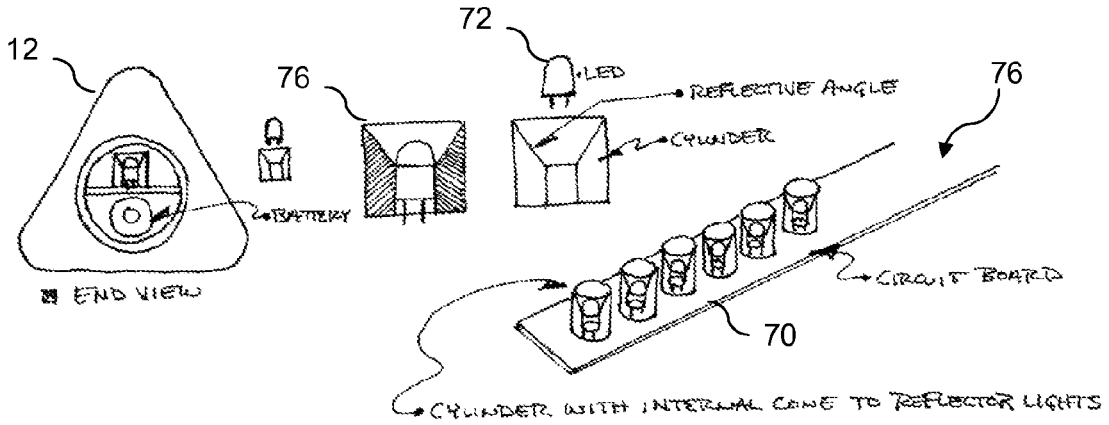
FIG. 23 is a schematic view of a reflector arrangement where each light emitting diode includes a separate cylinder with internal reflector cone, according to still further aspects of the present invention.

Referring to FIG. 23, as an exemplary alternative to the arrangement of FIG. 22, the circuit board 70 can host LEDs 72 so as to be spaced apart far enough such that each LED is individually coupled to a corresponding small reflector 76. Each reflector 76 comprises a cylinder with an internal cone shape to reflect light in a focused pattern. An LED 74 sits recessed into a corresponding reflector 76 so as to form a generally conical reflector about the LED.

Figure 24:
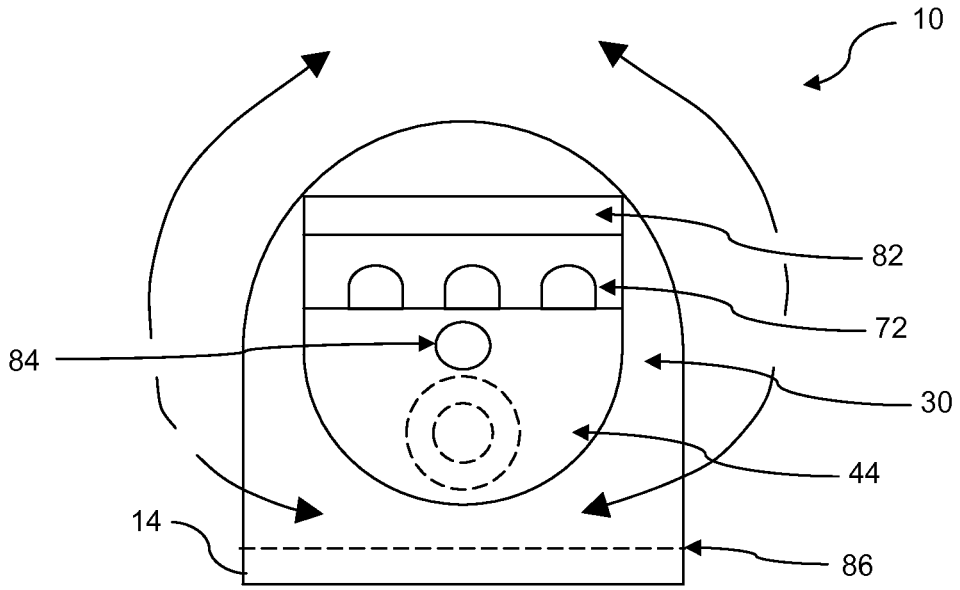
FIG. 24 is a side view of an illumination device where a light tube and an illumination assembly are integrated into a single component, according to further aspects of the present invention.

Referring to FIG. 24, an illumination source 10 is illustrated according to still further aspects of the present invention. The first and second end members each include only one faceted surface, and a curved edge portion. Moreover, the illumination assembly 30 is not contained within a light tube as per certain previous implementations. Rather, a shield 82 is disposed over the light source (LEDs 72 in this exemplary implementation). This shield 82 can comprise a clear shield, or the shield 82 can be semi-clear, frosted, etc. Further, the shield 82 can include a lens or other features to create a desired lighting feature. Moreover, the first and second end members each include a pivot point 84, as seen between the battery compartment 44 and the LEDs 72. A knob is not utilized in this exemplary implementation. Rather, a user can manually grab the illumination assembly 30 to rotate the light source (LEDs 72) to create the desired lighting effect. Thus, in this illustrative implementation, the illumination assembly 30 forms a case for the light and battery source to pivot about the pivot points 84.

This implementation can include other features. For instance, a bar, beam, bracket or other device can connect the first and second end members, as schematically represented by the dashed line 86, e.g., to define a Generally U-shaped bracket to hold the illumination assembly 30 for pivoting rotation about the pivot points 84. Thus, for instance, the illumination assembly 30 can be rotated such that the shield is proximate to, and parallel to the bar, e.g., to provide protection to the shield (e.g., to keep a lens and/or light source from getting scratched). Moreover, the bar 86 can be a solid color or clear, e.g., a clear plastic. Still further, the bar 86 can neck down, taper or take on other configurations, depending upon the application.

Figure 25:
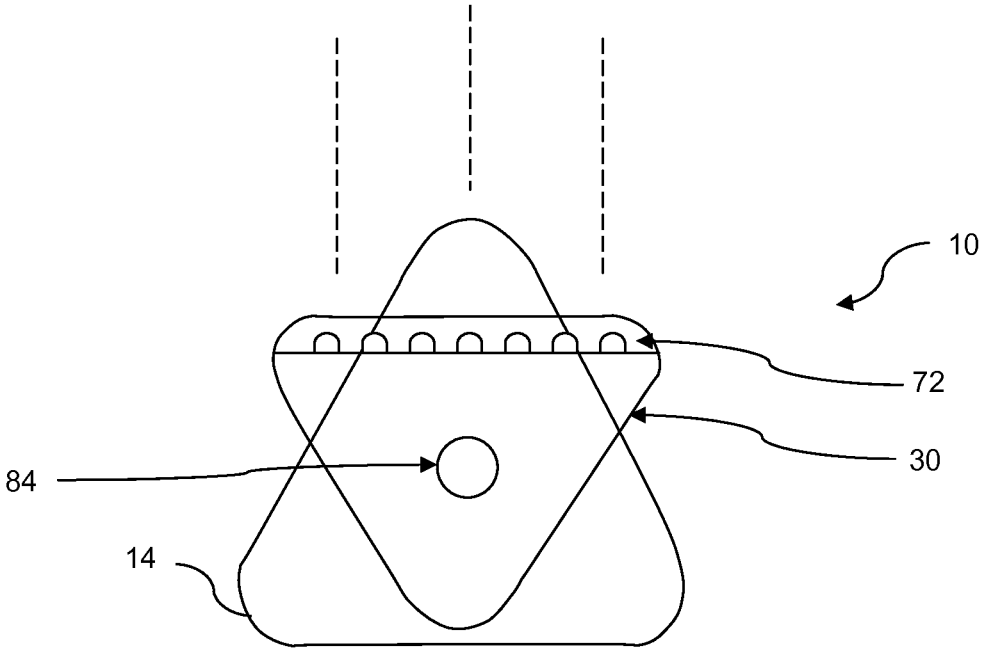
FIG. 25 is a side view of an illumination device where a light tube and an illumination assembly are integrated into a single component, and the light tube takes on a non-circular cross-section shape, according to aspects of the present invention.

Referring to FIG. 25, an illumination device 10 is illustrated with regard to still further aspects of the present invention. The illumination device 10 of FIG. 25 is analogous to the illumination device described with reference to FIG. 24, except that the first and second faceted end members 12, 14 are triangular in shape. Moreover, the illumination assembly is not round in cross-section as illustrated in previous exemplary configurations. In this manner, the illumination assembly can take on any reasonable shape so long as the illumination assembly 30 can rotate relative to the first and second end members 12, 14.

Figure 26:
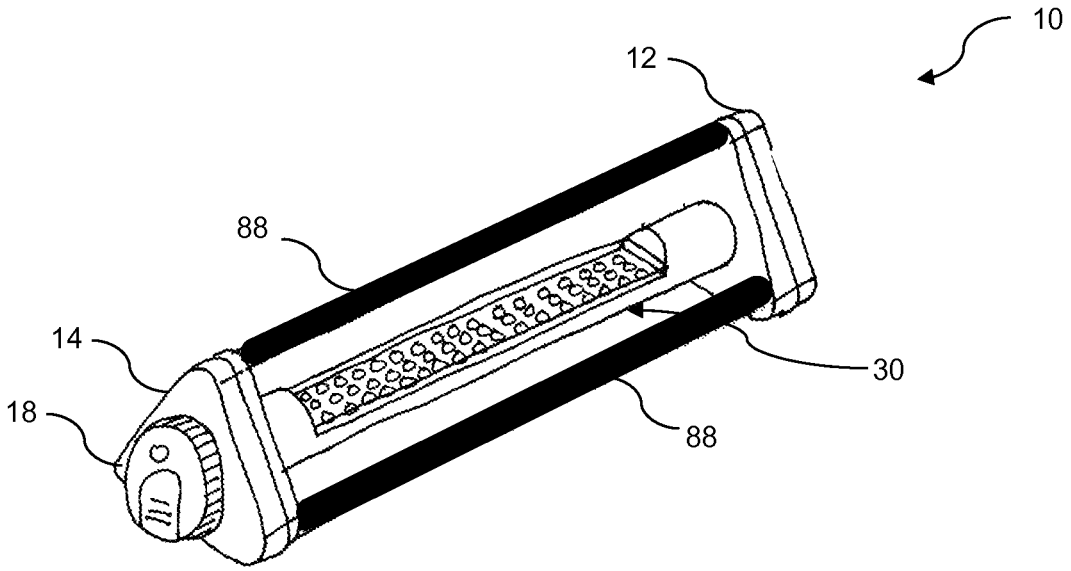
FIG. 26 is a perspective view of an illumination device according to yet further aspects of the present invention.

Referring to FIG. 26, yet another illustrative implementation of the illumination device 10 is shown. The illumination device is analogous to the illumination devices 10 described more fully herein. However, in this embodiment, the first and second end members are connected by three connect rods 88, one rod in each corner of the triangular shape of the first and second end members.

The features of any one of the illumination devices 10 shown herein can be combined with different features from other implementations to achieve a desired configuration.

With reference to the Figures generally, according to various aspects of the present invention, an illumination device 10 comprises a first end member 12 having at least one faceted surface along an edge thereof and a second end member 14 having at least one faceted surface along an edge thereof. An illumination assembly 30 has a light source, e.g., LEDs, light bulbs, etc., as described more fully herein, which are coupled between the first end member 12 and the second end member 14. For instance, the illumination assembly 30 can be inserted in a light tube 16, as described with reference to FIGS. 1-21, or the light tube in not required, e.g., as described with reference to FIGS. 24-26. In such arrangements, the light source can be covered by a shield such as the shield 82.

The illumination assembly 30 is manually rotatable so as to rotate a pattern of light emitted by the illumination device through a plurality of positions, such that the pattern of light covers 360 degrees when rotated through the plurality of positions, as described more fully herein. For instance, the illumination assembly 30 may be continuously rotatable about 360 degrees. The rotation of the light pattern may be accomplished by rotating the light source itself, as described throughout the specification. Alternatively, the rotation of the light pattern may be manually adjusted by rotating a reflector about the light source. For instance, an exemplary arrangement such as that illustrated with reference to FIGS. 6-7 (with or without the light tube 16) can be implemented.

As described more fully herein, in certain illustrative implementations, at least one faceted surface of the first end member 12 defines a support surface that allows the illumination device to rest on a surface in a first position. Moreover, at least one faceted surface of the second end member 14 also defines a support surface that allows the illumination device to rest on the surface in the first position such that the illumination device 10 contacts the surface at two discrete, spaced apart locations of contact.

Moreover, in certain illustrative implementations, a knob 18 extends from the second end member 14 such that rotation of the knob 18 causes a change in the direction of light emitted from the illumination device 10. The knob 18 can optionally be rotatable to continuously vary the rotational position of the pattern of light (or alternatively, to discretely step the rotational position of the pattern of light in discrete steps). Still further, the light source may be rotatable less than 360 degrees. Moreover, the knob 18 can be coupled to at least a section of the illumination assembly 30 such that rotation of the knob 18 causes a corresponding rotation within the light tube to change the direction of light emitted from the illumination device. Still further, in certain illustrative implementations, electronics including at least a power switch and wiring that forms a circuit with a battery when a battery is installed within the illumination device 10, such that rotation of the knob 18 causes corresponding rotation of the electronics. As yet another illustrative example, the illumination assembly 30 can include a battery compartment such that at least one battery is insertable therein for powering the light source.

According to still further alternative arrangements, an illumination device 10 may comprise a first end member 12 having at least one faceted surface along an edge thereof and a second end member 14 having at least one faceted surface along an edge thereof. An illumination assembly 30 comprising a light source is coupled between the first end member 12 and the second end member 14. In this regard, a cross-section of the illumination assembly 30 is smaller than the cross-section of both the first end member 12 and the second end member 14. For instance, as shown throughout the figures, a cross-section taken orthogonal to the Longitudinal length (L) labeled in FIG. 1, results in the light tube 16, and correspondingly, the illumination assembly 30, having a cross-section smaller than the cross-section of the end members. Under this arrangement, the cross-section of the first end member 12 and the cross-section second end member 14 are congruent, i.e., the same general shape and size.

Moreover, as noted in greater detail herein, the illumination assembly 30 is rotatable about an axis extending between the first and second end members 12, 14 such that manual rotation of the illumination assembly 30 causes a change in the direction of light emitted from the illumination device 10 relative to the stationary positioning of both of the first and second end members 12, 14. Rotation of the illumination assembly 30 can be accomplished using a knob such as the knob 18, or via other approaches, e.g., relying upon the user to grasp the illumination assembly 30 for manual rotation thereof.

According to various aspects of the present invention, as noted in greater detail above, the illumination device may comprise at least one magnet contained by the first end member and at least one magnet contained by the second end member. As such, the utility illumination device 10 is releasably securable through magnetic attraction with a magnetically attractive surface.

Further, the faceted surfaces along the edges of the first and second end members 12, 14 provide for a stable base when the illumination device 10 is oriented substantially horizontally. Moreover, the first end member 12 has an exterior major surface that is flat and forms a base sufficient to rest the illumination device 10 vertically on a surface. The illumination device 10 can utilize a cross section of the light tube that is smaller than the cross section of the first end member 12 and the second end member 14. Here, the light tube 16 is suspended between the first end member 12 and the second end member 14 such that positioning the illumination device 10 on a surface (so that the device rests on the faceted sections of the first and second end members 12, 14), suspends the light tube away from the surface. This allows stable placement of the illumination device 10, even on uneven surfaces.

As such, the illumination device 10 can illuminate an area above, below or to either side of the device. The rotation feature allows up to 360 degrees of rotation of the lights, reflector, or combination thereof, within the light tube 16.

Moreover, as described in greater detail herein, at least three adjustable illumination arrangements are described herein. In a first adjustable light arrangement, the light source of the illumination assembly comprises a plurality of light emitting diodes. A knob extends from a major surface of the second end member and is coupled to the illumination assembly such that rotation of the knob causes corresponding rotation of the light emitting diodes within the light tube so as to change the direction of light emitted from the illumination device.

In this regard, the illumination assembly can further comprise a reflector 74 as described with reference to FIG. 22, having a reflector channel defined by an elongate, generally concave member having a plurality of apertures, where each aperture sits over an associated one of the plurality of light emitting diodes. As an alternative example, a reflector 76 can comprise a reflector cylinder as illustrated in FIG. 23, which is situated over at least one light emitting diode, each reflector cylinder having an internal cone that receives an associated light emitting diode.

In a second adjustable light arrangement, the light source of the illumination assembly comprises a fluorescent bulb. A knob extends from a major surface of the second end member and is coupled to the illumination assembly such that rotation of the knob causes corresponding rotation of the fluorescent bulbs within the light tube so as to change the direction of light emitted from the illumination device.

In a third adjustable light arrangement, the illumination source of the illumination assembly comprises at least one fluorescent light and the illumination assembly further comprises a reflector. Moreover, a knob extends from a major surface of the second end member and is coupled to the reflector such that rotation of the knob causes corresponding rotation of the reflector so as to change the direction of light emitted from the illumination device.

Having thus described the invention of the present application in detail and by reference to embodiments thereof, it will be apparent that modifications and variations are possible without departing from the scope of the invention defined in the appended claims.

What is claimed is:

1. A portable illumination device, comprising:

a first end member having at least two faceted surfaces along a perimeter thereof;

a second end member having at least two faceted surfaces along a perimeter thereof;

a light tube book-ended between the first end member and the second end member such that the at least two faceted surfaces of the first end member are oriented in an aligned relationship with the at least two faceted surfaces of the second end member;

an illumination assembly within the light tube comprising a light source; and a knob that extends from the second end member and is coupled to at least a section of the illumination assembly such that rotation of the knob causes a corresponding rotation within the light tube to change the direction of light emitted from the illumination device;

wherein:

a cross section of the light tube is smaller than a cross section of the first end member and the second end member;

the illumination device is positionable on a flat surface such that a select one of the at least two faceted surfaces of each of the first and second end members rests on top of the flat surface and the light tube is suspended away from the flat surface by the first and second end members.

2. The illumination device according to claim 1, further comprising:

a fold-out hook that extends from a major surface of the first end member.

3. The illumination device according to claim 2, wherein:

the fold-out hook has a shape that is conformal to at least a portion of the periphery of the first end member; and the fold-out hook is operable between a first position generally flush with the major surface of the first end member and a second position folded out so as to extend in a direction perpendicular to the major surface of the first end member.

4. The illumination device according to claim 1, wherein:

the light source of the illumination assembly comprises a plurality of light emitting diodes; and the knob extends from a major surface of the second end member and is coupled to the illumination assembly such that rotation of the knob causes corresponding rotation of the light emitting diodes within the light tube so as to change the direction of light emitted from the illumination device.

5. The illumination device according to claim 4, further comprising:

a reflector channel defined by an elongated, generally concave member having a plurality of apertures, where each aperture sits over an associated one of the plurality of light emitting diodes.

6. The illumination device according to claim 4, further comprising:

a reflector cylinder situated over at least one light emitting diode, each reflector cylinder having an internal cone that receives an associated light emitting diode.

7. The illumination device according to claim 1, wherein:

the illumination source of the illumination assembly comprises at least one fluorescent light;

the illumination assembly further comprises a reflector; and the knob extends from a major surface of the second end member and is coupled to the reflector such that rotation of the knob causes corresponding rotation of the reflector so as to change the direction of light emitted from the illumination device.

8. The illumination device according to claim 1, further comprising:

a first pivot-out hook pivotally coupled to the first end member; and a second pivot-out hook pivotally coupled to the second end member;

wherein:

the first pivot-out hook is conformal to the periphery of at least a portion of the first end member; and the second pivot-out hook is conformal to the periphery of at least a portion of the second end member.

9. The illumination device according to claim 8, wherein:

the first end member has a cross-sectional shape that includes a first corner;

the first pivot-out hook is pivotally coupled to the first end member proximate to the first corner adjacent to an inside major surface thereof;

the first pivot-out hook comprises a hook arm that conformally follows the contour of a portion of the first end member; and the hook arm includes at least one flat edge for resting on a flat surface.

10. The illumination device according to claim 1, wherein:

the first end member and the second end member are generally triangular shaped and congruent.

11. The illumination device according to claim 1, further comprising:

at least one magnet contained by the first end member; and at least one magnet contained by the second end member;

wherein:

the illumination device is releasably securable through magnetic attraction with a magnetically attractive surface.

12. The illumination device according to claim 1, wherein:

the first end member has an exterior major surface that is flat and forms a base sufficient to rest the illumination device vertically on a surface.

13. The illumination device according to claim 1, wherein:

the at least one faceted surface along an edge of the first and second end members forms a base that is sufficient to rest the illumination device horizontally on the surface.

14. The illumination device according to claim 1, further comprising:

a battery compartment that contains batteries for powering the illumination source that is accessed through a battery compartment cover on the knob.

15. The illumination device according to claim 1, wherein:

the light source of the illumination assembly comprises a plurality of light emitting diodes;

the light emitting diodes are mounted on a carrier that is rotatably mounted within the light tube and is coupled to the knob; and a battery compartment is defined within the light tube such that the carrier divides the batteries from the light emitting diodes.

16. The illumination device according to claim 1, wherein:

the at least one faceted surface of the first end member defines a support surface to rest the illumination device on a surface in a first position; and the at least one faceted surface of the second end member defines a support surface to rest the illumination device on the surface in the first position such that the illumination device contacts the surface at two discrete, spaced apart locations of contact.

17. The illumination device according to claim 1, wherein:

the knob is manually rotatable so as to rotate a pattern of light emitted by the illumination device to cover 360 degrees.

18. The illumination device according to claim 1, wherein:

the knob is coupled to at least a section of the illumination assembly such that rotation of the knob causes a corresponding rotation of the illumination assembly within the light tube to change the direction of light emitted from the illumination device.

19. The illumination device according to claim 1, further comprising:

electronics including at least a power switch and wiring that forms a circuit with a battery, when a battery is installed within the illumination device, such that rotation of the knob causes corresponding rotation of the electronics.

20. The illumination device according to claim 1, wherein:

the illumination assembly further comprises a battery compartment such that at least one battery is insertable within the light tube for powering the light source.

* * * * *